US007958683B2

(12) United States Patent
Abusada et al.

(10) Patent No.: US 7,958,683 B2
(45) Date of Patent: Jun. 14, 2011

(54) WALL PANEL SYSTEM

(75) Inventors: Sam E. Abusada, Iowa City, IA (US); Travis E. Wright, Morning Sun, IA (US); Nicholas Stubbe, North Liberty, IA (US); Darren Zaugg, Muscatine, IA (US); Benjamin J. Proctor, Tipton, IA (US); Steve V. Lindeen, Oakville, IA (US); Robert R. Hill, Muscatine, IA (US)

(73) Assignee: HNI Corporation, Muscatine, IA (US)

( * ) Notice: Subject to any disclaimer, the term of this patent is extended or adjusted under 35 U.S.C. 154(b) by 722 days.

(21) Appl. No.: 11/867,327

(22) Filed: Oct. 4, 2007

(65) Prior Publication Data

US 2009/0090076 A1 Apr. 9, 2009

(51) Int. Cl.
*E04H 1/00* (2006.01)

(52) U.S. Cl. ..... 52/239; 52/36.1; 52/238.1; 52/242

(58) Field of Classification Search ..... 52/241, 52/242, 36.1, 220.7, 282.2, 656.9; 160/135
See application file for complete search history.

(56) References Cited

U.S. PATENT DOCUMENTS

| | | | | |
|---|---|---|---|---|
| 3,545,796 | A | 12/1970 | Nicholls | |
| 4,561,229 | A * | 12/1985 | Gartung | 52/239 |
| 4,571,907 | A | 2/1986 | DeFouw et al. | |
| 4,625,483 | A | 12/1986 | Zacky et al. | |
| 4,833,848 | A * | 5/1989 | Guerin | 52/242 |
| 4,971,281 | A | 11/1990 | Steinbeck | |
| 5,058,347 | A | 10/1991 | Schuelke et al. | |
| 5,682,719 | A * | 11/1997 | Huang | 52/775 |
| 5,743,055 | A | 4/1998 | Conner et al. | |
| 6,141,926 | A | 11/2000 | Rossiter et al. | |
| 6,167,665 | B1 | 1/2001 | Dame et al. | |
| 6,202,381 | B1 | 3/2001 | Dame et al. | |
| 6,223,485 | B1 | 5/2001 | Beck et al. | |
| 6,295,764 | B1 | 10/2001 | Berridge et al. | |
| 6,301,847 | B1 | 10/2001 | Beck et al. | |
| 6,330,773 | B1 | 12/2001 | MacDonald et al. | |
| 6,339,907 | B1 | 1/2002 | Dame et al. | |
| 6,349,516 | B1 | 2/2002 | Powell et al. | |
| 6,389,773 | B1 * | 5/2002 | Reuter et al. | 52/582.2 |
| 6,393,782 | B1 | 5/2002 | Berridge et al. | |
| 6,729,085 | B2 | 5/2004 | Newhouse et al. | |
| 6,792,733 | B2 * | 9/2004 | Wheeler et al. | 52/656.1 |
| 6,820,388 | B2 | 11/2004 | Newhouse et al. | |
| 6,865,853 | B2 * | 3/2005 | Burken et al. | 52/239 |
| 6,868,853 | B1 * | 3/2005 | Nilsson et al. | 128/203.15 |
| 6,964,138 | B2 * | 11/2005 | Carroll et al. | 52/239 |
| 2003/0233810 | A1 * | 12/2003 | Wildeman | 52/794.1 |

FOREIGN PATENT DOCUMENTS

| | | |
|---|---|---|
| CA | 2 270 709 | 1/1999 |
| DE | 93 01 112 | 7/1993 |
| EP | 1 710 452 | 10/2006 |
| FR | 2 268 970 | 11/1975 |
| GB | 0 112 945 | 9/1918 |

* cited by examiner

OTHER PUBLICATIONS

International Search Report and Written Opinion Issued in PCT/US2008/077165, mailed Dec. 14, 2009. "HNI Corporation Introduces an Industry First: Agri-Fiber Panel Substrate for Workstations", Muscatine, Iowa Business Wire, Jan. 25, 2007, 2 pages.

*Primary Examiner* — Brian E Glessner
*Assistant Examiner* — Adam Barlow
(74) *Attorney, Agent, or Firm* — Faegre & Benson LLP

(57) ABSTRACT

An improved wall panel system is disclosed. The system includes framed panels having side frame members, a top frame member, and a bottom support structure. Also included are a plurality of connection components including a connector post, an I-beam shaped connector, connectors, and decorative caps.

26 Claims, 18 Drawing Sheets

244
206
242
250
248
246

248
242
250
206
244
248
246

250
242
244
206
248
248
246

248
242
206
250
248
244
246

242
250
206
248
248
246

242
244
206
248
248
246

242
206
244
248
246

248
250
248
206
242
244

244
206
242
246
248
250
248

WALL PANEL SYSTEM

TECHNICAL FIELD

The present invention relates to an improved wall panel system.

BACKGROUND

Wall panel systems typically are used to form office work spaces that are efficient, generally inexpensive when compared to fixed wall offices, and have an ability to be adjustable. Examples of such systems are shown in U.S. Pat. Nos. 6,964,138; 6,339,907; 6,330,773; 6,349,516; 5,743,055 and 4,971,281, all of which are incorporated herein by reference. Wall panel systems are also illustrated in catalogs, such as in BPI's catalog for its PARALLEL brand system. This catalog is also incorporated herein by reference. However, such wall panel systems can be relatively expensive, difficult to assemble, complicated and not versatile.

SUMMARY

A wall panel assembly having a framed panel including two side frame members, a top frame member connected to the side frame members, and a bottom support structure also connected to the side frame members. The wall panel assembly also includes a plurality of connectors, such as an I-beam connector post, corner connectors, frame connectors, among others. These connectors secure framed panels to each other. Aesthetically pleasing decorative caps are also included for covering exposed parts and surfaces.

DETAILED DESCRIPTION

While multiple embodiments of the instant invention are disclosed, still other embodiments may become apparent to those skilled in the art. The following detailed description shows and describes illustrative embodiments of the invention, which description is not intended for limiting the invention in any form or manner. All alternative embodiments of the invention are within the spirit, scope, and intent of the disclosed invention.

Figure 1:
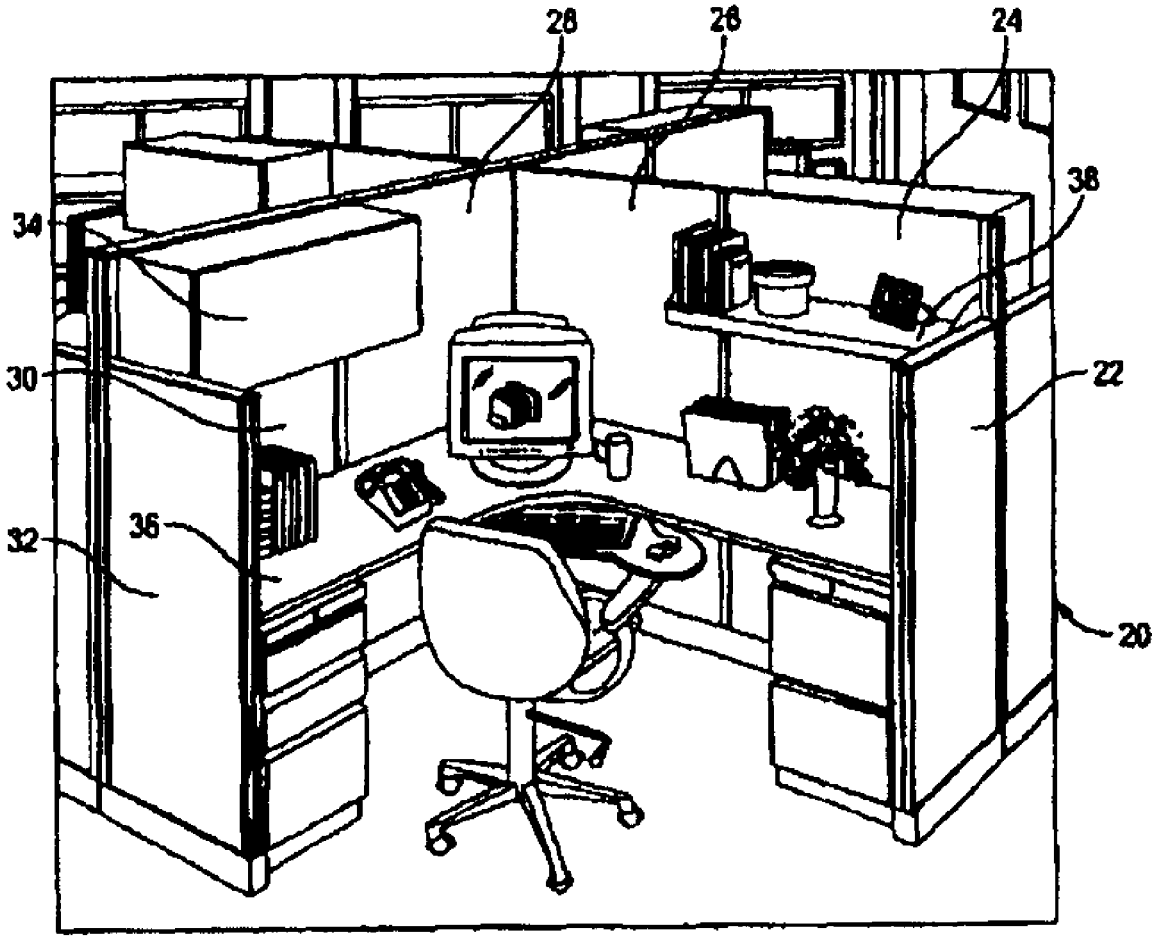
FIG. 1 is an isometric view of a work area defined by a combination of wall panel assemblies.

FIG. 1 illustrates an embodiment of a work area defined by connecting together several wall panel assemblies 20, 22, 24, 26, 28, 30 and 32 of different shapes and sizes. Alternate embodiments include wall panel assemblies of the same size or shape or both. FIG. 1 is an exemplary illustration of a work area having common wall panel assemblies, storage cabinet 34, desk 36, and shelf 38.

Figure 2:
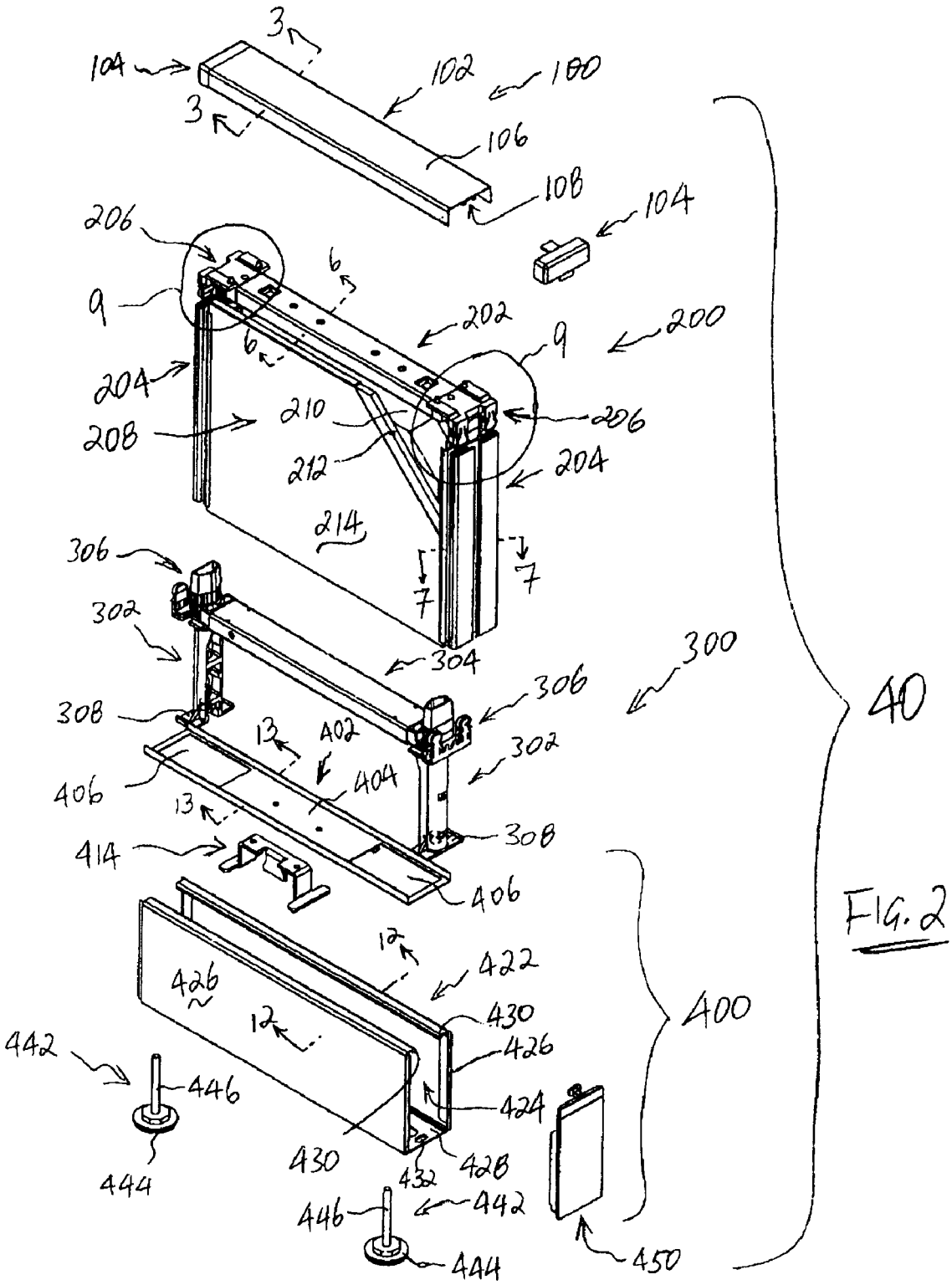
FIG. 2 is an isometric view of an embodiment of a wall panel assembly.

FIG. 2 is a perspective view of the components comprising wall panel assembly 40. Assembly 40 includes decorative top cap assembly 100, framed panel 200, panel bottom support structure 300, and base rail cover 400. In an embodiment of wall panel assembly 40, decorative top cap assemblies, such as assembly 100, provide an aesthetically pleasant finish by covering exposed parts and surfaces. Similarly, base rail covers, such as cover 400, provide an aesthetically pleasant finish for framed panel 200 by covering the bottom member and bottom support structure 300.

An embodiment of decorative top cap assembly 100, such as that of FIG. 2, includes decorative top cap 102 and decorative end cap 104 at each end of frame 102. An alternate embodiment of decorative top cap assembly 100 includes a decorative transition cap, such as that described herein below with reference to FIG. 5, at each end of frame 102. Another embodiment (not shown) of decorative top cap assembly 100 includes a decorative transition cap at one end of decorative top cap frame 102 and decorative end cap 104 at the other end of frame 102.

Figure 3:
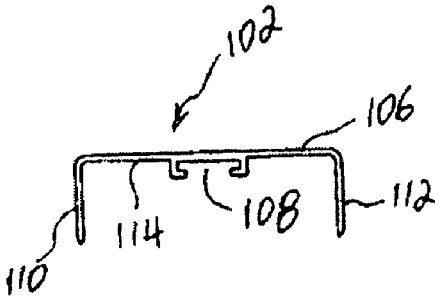
FIG. 3 is a cross-sectional view of an embodiment of a top cap frame.

FIG. 3 is a cross-sectional view of an embodiment of decorative top cap frame 102 having a generally U-shaped frame 106 with side arms 110 and 112 and channel 108 on the inside top surface 114 of frame 106. Channel 108 is configured for engaging either one of decorative end cap 104 or decorative transition cap, both of which decorative caps are described herein below with reference to FIGS. 4 and 5, respectively.

Figure 4:
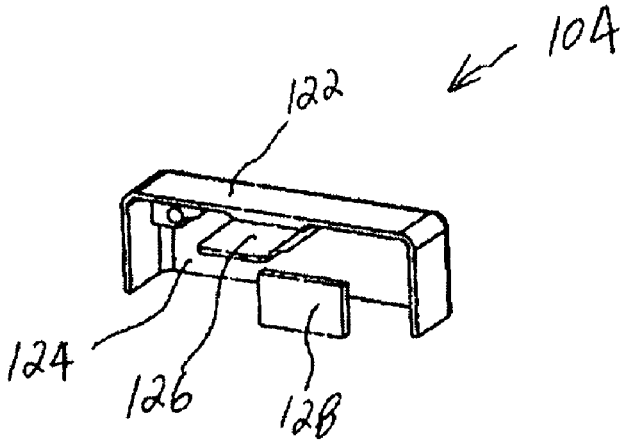
FIG. 4 is an isometric view of an embodiment of an end cap for a top cap.

FIG. 4 is a perspective view of an embodiment of decorative end cap 104 having a generally U-shaped element 122 with cover or end wall 124, horizontal tab 126, and vertical tab 128. Horizontal tab 126 is configured for engagement within channel 108. Vertical tab 128 extends from a surface of end wall 124 and is configured for engagement within a channel in a first frame corner connector as described herein below in reference to FIGS. 8-10.

Figure 5:
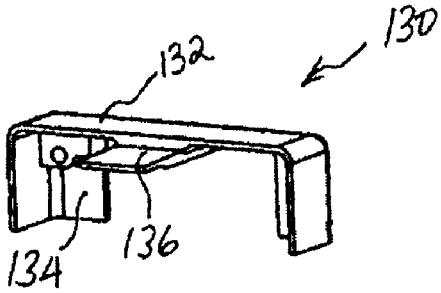
FIG. 5 is an isometric view of an embodiment of a transition cap for a top cap.

FIG. 5 is a perspective view of an embodiment of decorative transition cap 130 having a generally U-shaped element 132 with a partially open cover or end wall 134, and horizontal tab 136. Horizontal tab 136 is configured for engagement within channel 108. Decorative end cap 104 and decorative transition cap 130 are substantially similar, a difference being with respect to end walls 124 and 134. Scoring a portion of end wall 124 around vertical tab 128 such that the section is removable, end wall 124 and decorative end cap 104, respectively, are transformed into end wall 134 and decorative transition cap 130.

Referring back to FIG. 2, an embodiment of framed panel 200 includes top frame member 202, substantially similar left and right side frame members 204, and panel bottom support structure 300. First frame corner connector 206 (described below in reference to FIG. 8) connects each end of top frame member 202 to an end of each side frame member 204 as described below in reference to FIGS. 9 and 10. Panel bottom support structure 300 includes support members 302 and bottom frame member 304. An embodiment of each support member 302 (described below in reference to FIG. 11) includes second frame corner connector 306 at one end and includes feet 308 at the other end. Second frame corner connector 306 connects each end of bottom frame member 304 to an end of each side frame member 204.

As illustrated in FIG. 2, framed panel 200 includes panel 208 encased in the frame assembled from the combination of top and bottom frame members 202 and 304, respectively, and side frame members 204. An embodiment of panel 208 includes core 210 having fabric 214 stretched over the entire surface on either side of panel 212. In an alternate embodiment, panel 208 includes core 210 sandwiched between panels 212 having fabric 214 stretched over the entire surface of panel 212 opposite the surface adjacent to core 210.

Figure 6:
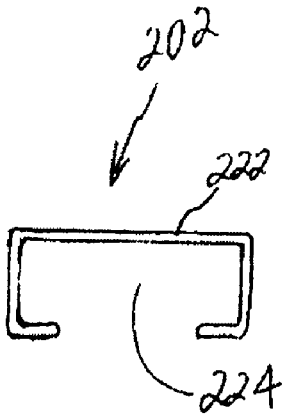
FIG. 6 is a cross-sectional view of an embodiment of a top frame member.

FIG. 6 is a cross-sectional view of an embodiment of top frame member 202 having a generally C-shaped frame 222 around channel 224. Channel 224 is configured for engaging a portion of first frame corner connector 206. An alternate embodiment (not shown) of top frame member 202 includes a tube having a channel configured for engaging a portion of first frame corner connector 206.

Figure 7:
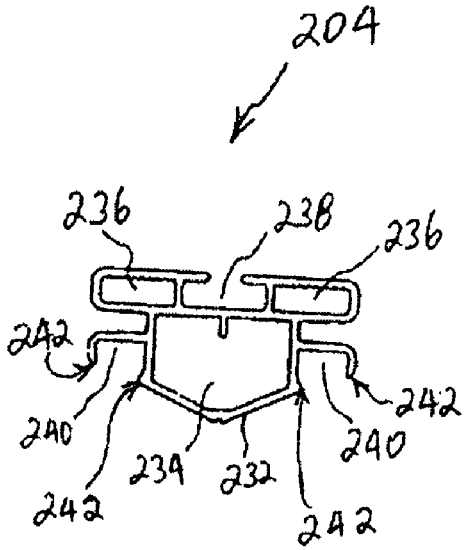
FIG. 7 is a cross-sectional view of an embodiment of a side frame member.

FIG. 7 is a cross-sectional view of an embodiment of side frame member 204. Side frame member 204 includes frame 232 having primary channel 234 and first and second retaining channels 236 adjacent primary channel 234. Channels 234 and 236 are configured for engaging a portion of first frame corner connector 206. Side frame member 204 also includes channel 238 configured for engaging connection components or extension tabs or both. Side frame member 204 includes first and second side channels 240 is configured for receiving, engaging, and retaining therein, the side edges of panels 212. An embodiment of side channels 240 includes hook-like configurations 242 for grasping the surfaces of panels 212.

Figures 8, 8A, 8B, 8C, 8D, 8E, 8F, 8G, 8H, 8I:
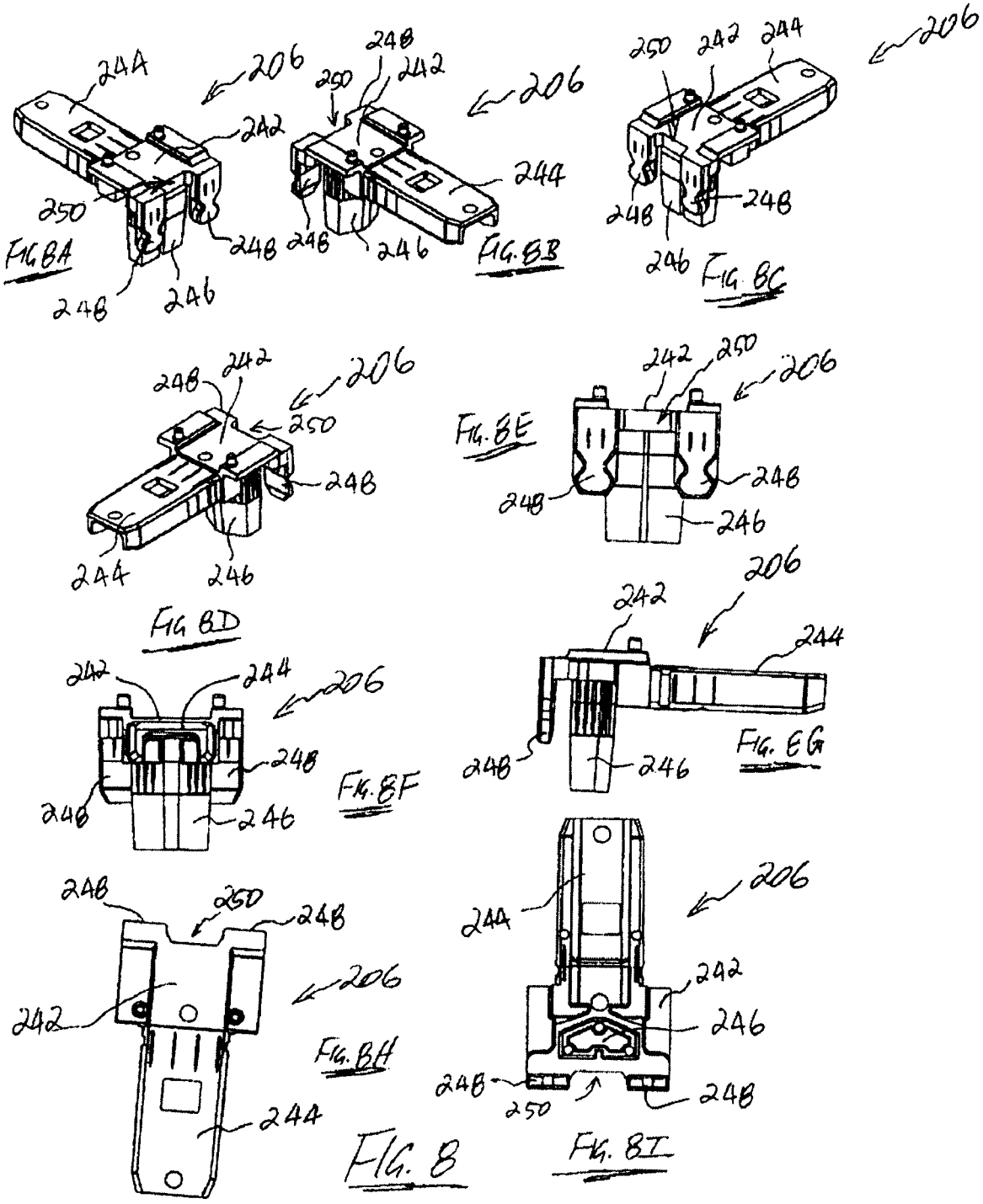
FIG. 8 includes several views of an embodiment of a first frame corner connector.

FIG. 8 includes several views of an embodiment of first frame corner connector 206 having intermediate portion 242 with first arm 244 extending therefrom. First arm 244 is configured for engagement within channel 224 at an end of top frame member 202. Intermediate portion 242 also includes second arm 246 extending therefrom at an angular offset relative to first arm 244. Second arm 246 is configured for engagement within primary channel 234 at an end of side frame member 204. Intermediate portion 242 further includes spaced apart first and second prongs 248 defining channel 250 therebetween. Prongs 248 and channel 250 extend from intermediate portion 242 in the same general orientation as second arm 246. First and second prongs 248 are adjacent second arm 246, and are configured for engagement within first and second retaining channels 236 at the same end of side frame member 204 whereat second arm 246 engages within primary channel 234.

FIGS. 8A through 8D are perspective views of first frame corner connector 206 as viewed from different angles. FIGS. 8E and 8F are end views of first frame corner connector 206 as viewed, respectively, facing the side having prongs 248 and facing the tip of first arm 244. FIG. 8G is a side view, and FIGS. 8H and 8I, respectively, are the top and bottom views of first frame corner connector 206. First and second arms 244 and 246 are shown generally orthogonal to each other. Second arm 246 and prongs 248 are shown generally parallel to each other, both extending in the same general direction from intermediate portion 242.

In an alternate embodiment of the first frame corner connector (not shown), the first and second arms are offset at an angle other than 90 degrees. In another embodiment of the first frame corner connector (also not shown), the first and second prongs are not parallel to the first or the second arm, or both. In yet another embodiment of the first frame corner connector (not shown), the first and second prongs extend from the intermediate portion in a direction different from that of the first or the second arm, or both. As will be apparent to one skilled in the art, the first frame corner connector is amenable to several alternative designs and configurations as dictated by its use as a connector.

Figure 9:
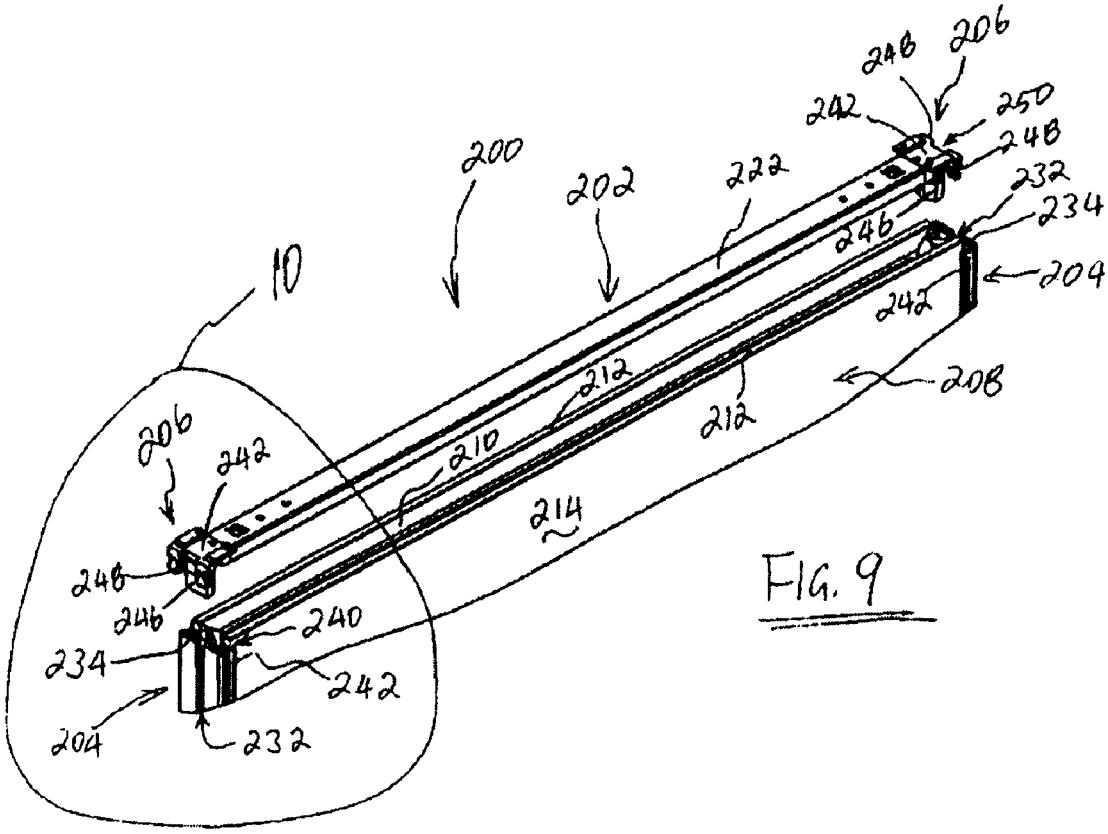
FIG. 9 is a perspective view of an embodiment of a top frame member positioned over the top surface of the panel.
Figure 10:
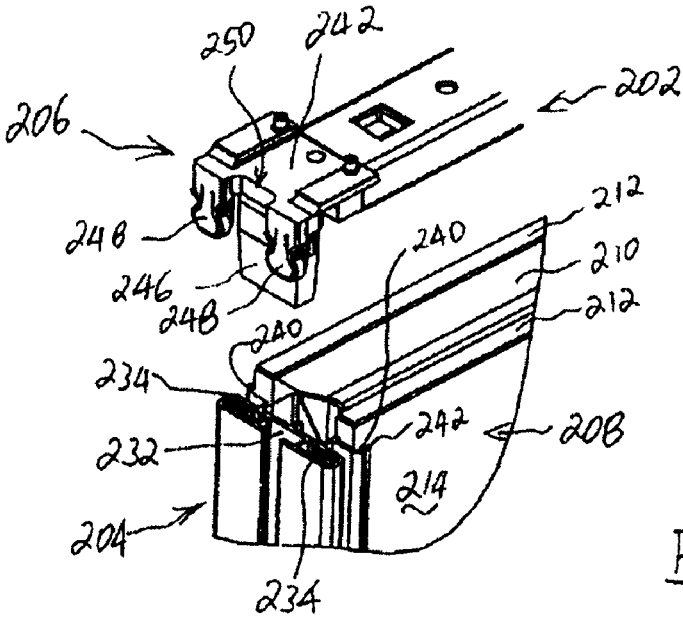
FIG. 10 is a perspective view of a corner connection in the assembly of FIG. 9.

An embodiment of a method for assembling the top and side frame members 202 and 204, respectively, will now be described. The positioning of the several components during an assembly process is illustrated in FIGS. 9 and 10. FIG. 9 is a perspective view of the full length of top frame member 202 shown positioned over the top surface of panel 208. FIG. 10 is a detailed perspective view of the corner labeled 10 in FIG. 9. Framed panel 200 is shown having side frame member 204 engaging a side edge (or surface) of panel 208. As previously discussed with reference to FIG. 7, hook-like configurations 242 in first and second side channels 240 are shown grasping the edge-side surfaces of panels 212 whereby side frame member 204 engages panel 208. Also as previously discussed with reference to FIGS. 6 and 8, top frame member 202 includes channel 224 configured for receiving and engaging first arm 244 of first frame corner connector 206. Accordingly, top frame member 202 is shown in FIGS. 9 and 10 having first frame corner connector 206 engaged in an end thereof. As discussed with reference to FIGS. 7 and 8, side frame member 204 includes primary channel 234 configured for receiving and engaging second arm 246; and side frame member 204 also includes first and second retaining channels 236 configured for receiving and engaging first and second prongs 248. Although not shown in FIGS. 9 and 10, second arm 246 is aligned with the opening of primary channel 234, and first and second prongs 248 are aligned with the openings of first and second retaining channels 236. Next, the end of top frame member 202 having first frame corner connector 206 engaged therein is connected to an end of side frame member 204 by forcing second arm 246 into primary channel 234, and forcing prongs 248 into retaining channels 236 until top frame member 202 is positioned adjacent the top surface of panel 208.

Figure 11:
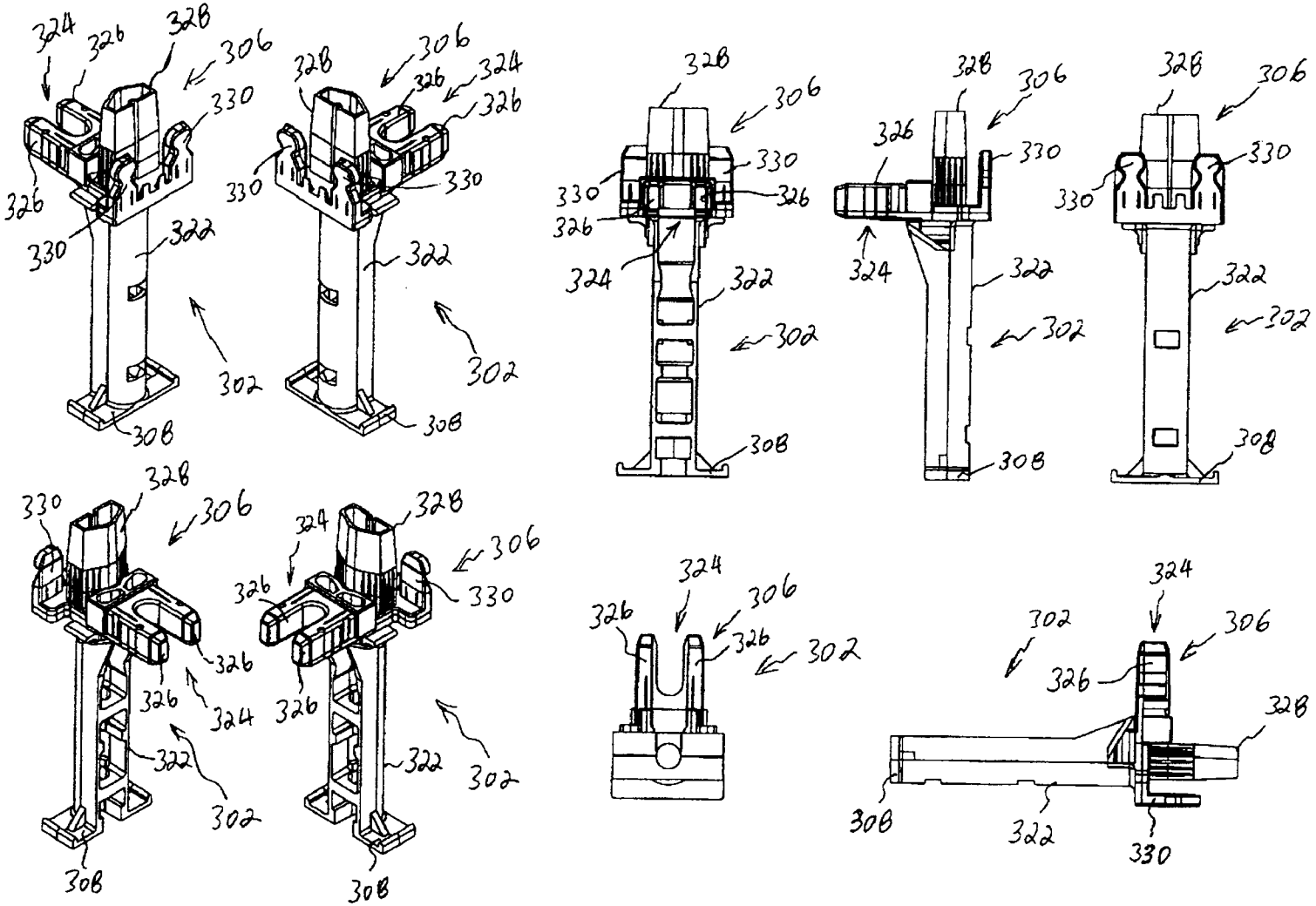
FIG. 11 includes several views of an embodiment of a support member including a second frame corner connector.

FIG. 11 includes several views of an embodiment of support member 302 having feet 308 at an end of column 322 and second frame corner connector 306 at the other end of column 322. Second frame corner connector 306 connects each end of bottom frame member 304 to an end of each side frame member 204. An embodiment of second frame corner connector 306 includes first arm 324 having forks 326 extending at an angular offset relative to column 322. First arm 324 and forks 326 are configured for engagement within the channel (not shown) of bottom frame member 304. The embodiment of second frame corner connector 306 illustrated in FIG. 11 includes second arm 328 extending beyond the end of column 322 and at an angular offset relative to first arm 324. In an embodiment of second frame corner connector 306, second arm 328 is an extension of column 322. In another embodiment, second arm 328 extends parallel to column 322 along a plane offset from the plane of column 322. Second arm 328 is configured for engagement within primary channel 234 in side frame member 204. Second frame corner connector 306 further includes spaced apart prongs 330 extending at an angular offset relative to column 322 and in the same general orientation as second arm 328. Prongs 330 are adjacent second arm 328, and are configured for engagement within first and second retaining channels 236 at the same end of side frame member 204 whereat second arm 328 engages within primary channel 234. Panel bottom support structure 300 is formed by engaging first arm 324 and forks 326 of second frame corner connector 306 at each end of bottom frame member 304. Second arm 328 and prongs 330, respectively, are engaged within primary channel 234 and first and second retaining channels 236 at the same end of side frame member 204. Framed panel 200 is supported on panel bottom support structure 300 in accordance with an embodiment of the invention.

An embodiment of base rail cover 400, such as that illustrated in FIG. 2, includes base rail channel 402 fixedly attached to a surface of bottom frame member 304 opposite the surface adjacent the bottom surface of panel 208. Base rail channel 402 includes mounting region 404 having openings 406 at each end thereof. Openings 406 are configured such that support members 302 do not interfere in the attachment of rail channel 402 to the bottom frame member 304.

Figure 12:
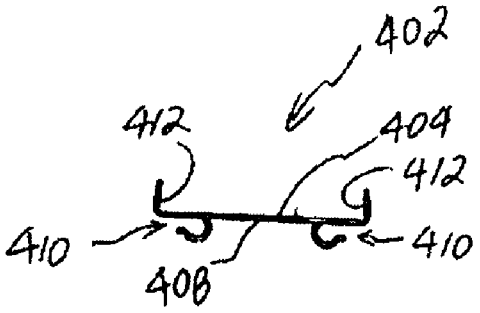
FIG. 12 is a cross-section view of the base rail channel taken along line 12-12 of FIG. 2.

As perhaps best illustrated in FIG. 12, base rail channel 402 is formed in the shape of a channel having inner surface 404, outer surface 408, and circular channels 410 on outer surface 408. Channel walls 412 extending out of the plane of inner surface 404 are configured for grasping and engaging the side walls of bottom frame member 304.

Referring back to FIG. 2, an embodiment of base rail cover 400 includes electrical mounting bracket 414 fixedly attached to outer surface 408 of base rail channel 402. A generally U-shaped base cover 422 is attached to the bottom of wall panel assembly 40 for covering and hiding from view panel bottom support structure 300, base rail channel 402, electrical mounting bracket 414, and any electrical wiring or cables, or both along the bottom of wall panel assembly 40.

Figure 13:
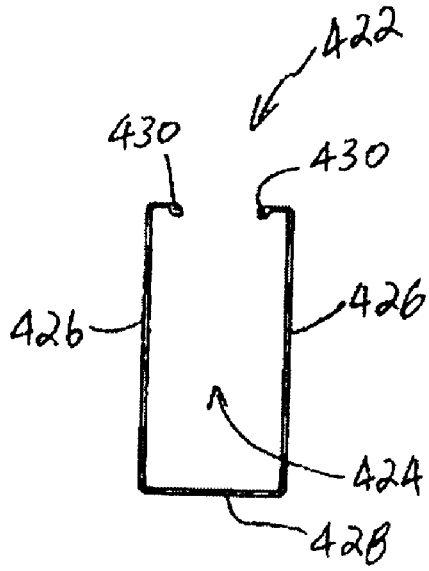
FIG. 13 is a cross-section view of the base cover taken along line 13-13 of FIG. 2.

As perhaps best illustrated in FIG. 13, the generally U-shaped base cover 422 includes channel 424 having arms or side walls 426, and base 428. Beads 430 extending the length of channel 424 are formed at the extremities of arms 426, and are configured for engagement within circular channels 410 on outer surface 408 of base rail channel 402. Arms 426 of base cover 422 can be disengaged from base rail channel 402 providing easy access for the repair and/or installation of communications and/or electrical wiring placed along the bottom of wall panel assembly 40.

Referring back to FIG. 2, an embodiment of base rail cover 400 for wall panel assembly 40 includes a plurality of adjustable glides 442 having base 444 fixedly attached to threaded stem 446. Each threaded stem 446 is configured for being received by support member 302, such that the height of wall panel assembly 40 is easily adjustable by clockwise or counterclockwise rotation of each adjustable glide 442.

Figure 14:
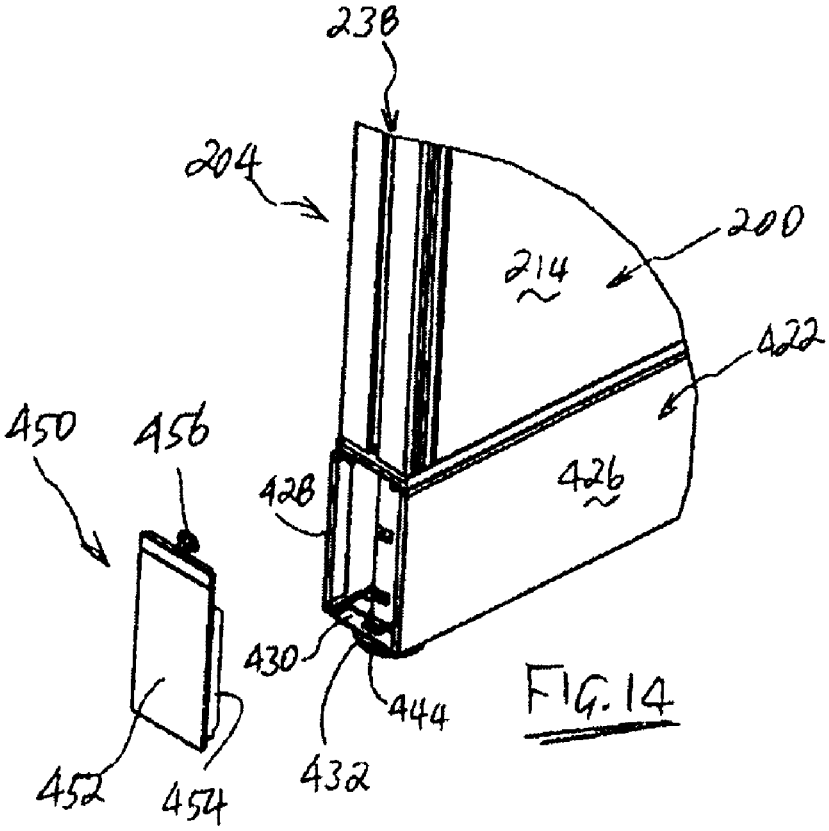
FIG. 14 is a perspective view of an embodiment of a base end cap for the base cover.

FIG. 14 is a close-up perspective view of base end cap 450 for capping or closing the open end of base cover 422. Base end cap 450 includes end wall 452, arms 454 (of which only one is shown) along each side edge of end wall 452, and a base (not shown) extending from the bottom edge. The base includes an opening (also not shown) which aligns with opening 432 proximate an end of base 428 of base cover 422. Base end cap 450 can be fixedly secured to base cover 422 with a fastener. As a further fastening means, base end cap 450 includes tab 456 configured for engagement within channel 238 of side frame member 204. The combination of the base cover 422 and the base end cap 450 provides an aesthetically pleasing finish for the wall panel assembly 40.

Figure 15:
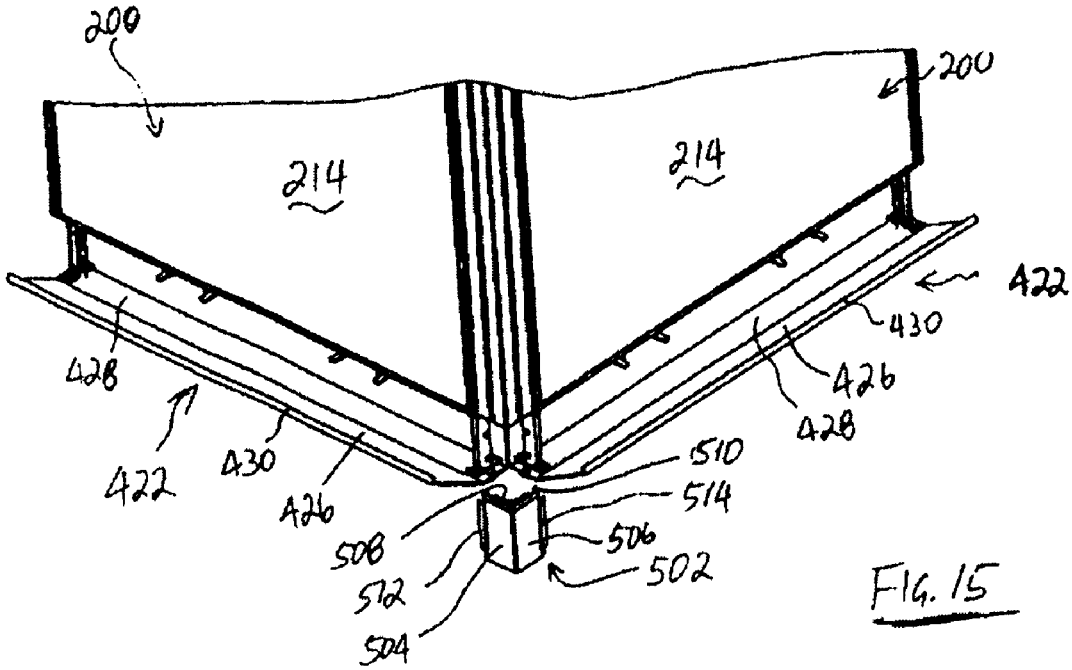
FIG. 15 is a perspective view of a corner base end cap.

FIG. 15 is a close-up perspective view of corner base end cap 502. An embodiment of corner base end cap 502 includes orthogonally aligned walls 504 and 506, upright insert tabs 508 and 510 along each top edge of walls 504 and 506, and arms 512 and 514 along each side edge of walls 504 and 506. Upright insert tabs 508 and 510 are configured for slidably engaging a connector post (described below in reference to FIG. 21) connecting two framed panels 200. Arms 512 and 514 are configured for slidably engaging the inside surface of arms 426 of base cover 422.

Figure 16:
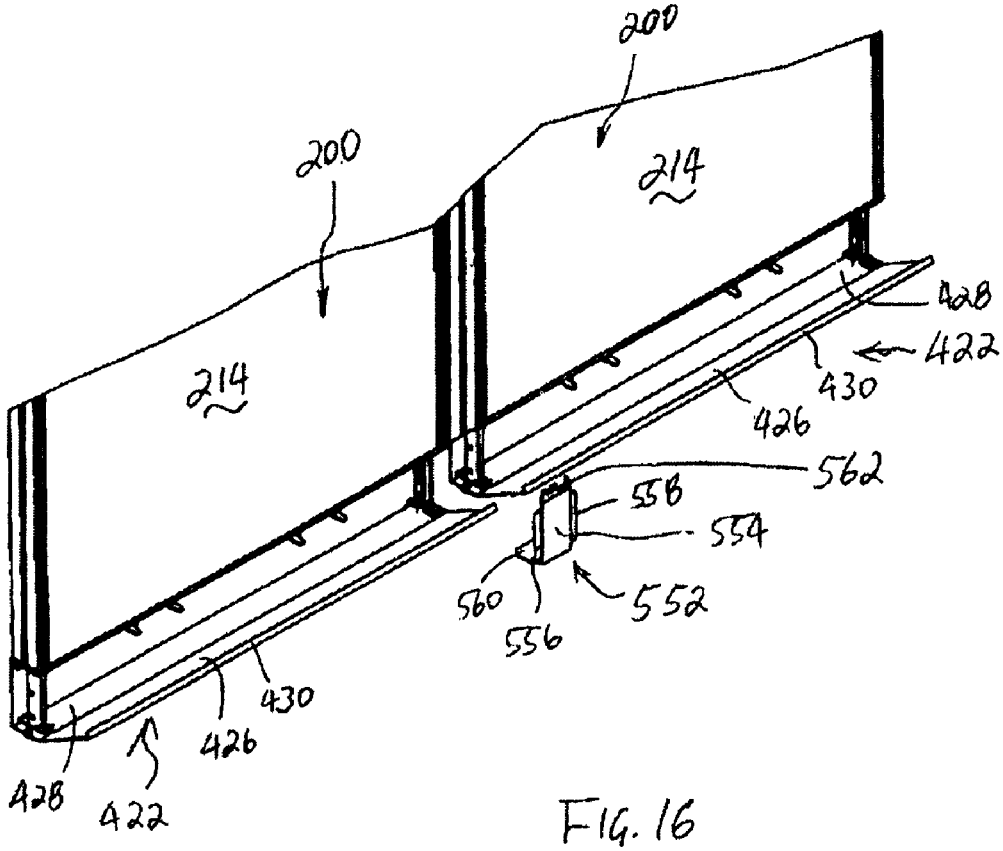
FIG. 16 is a perspective view of a base cap for the base cover.

FIG. 16 is a close-up perspective view of base cap 552 for bridging the opening or the gap between base covers 422 of two laterally connected framed panels 200. An embodiment of base cap 552 includes wall 554, arms 556 and 558 along each side edge of wall 554, base 560, and upright insert tab 562 along the top edge of wall 554. Upright insert tab 562 is configured for engaging in the space between adjacent side frame members 204. Arms 556 and 558 are configured for slidably engaging the inside surface of arms 426 of base cover 422.

Figure 17:
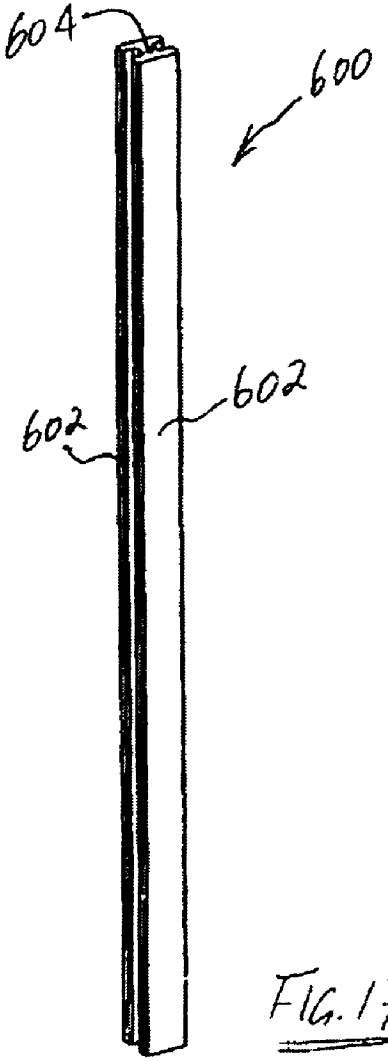
FIG. 17 is an isometric view of an embodiment of an I-beam connector.

FIG. 17 is an isometric view of I-beam connector 600 used for connecting together wall panel assemblies 200 along side frame member 204 of each wall panel assembly 200. In an alternate embodiment, I-beam connector 600 attaches side frame member 204 to a connector post (described below in reference to FIG. 21). An embodiment of I-beam connector 600 includes spaced apart arms 602 connected by bridge 604. Each arm 602 is configured for slidable engagement within channel 238 on each side frame member 204 or a channel on the connector post.

Figure 18:
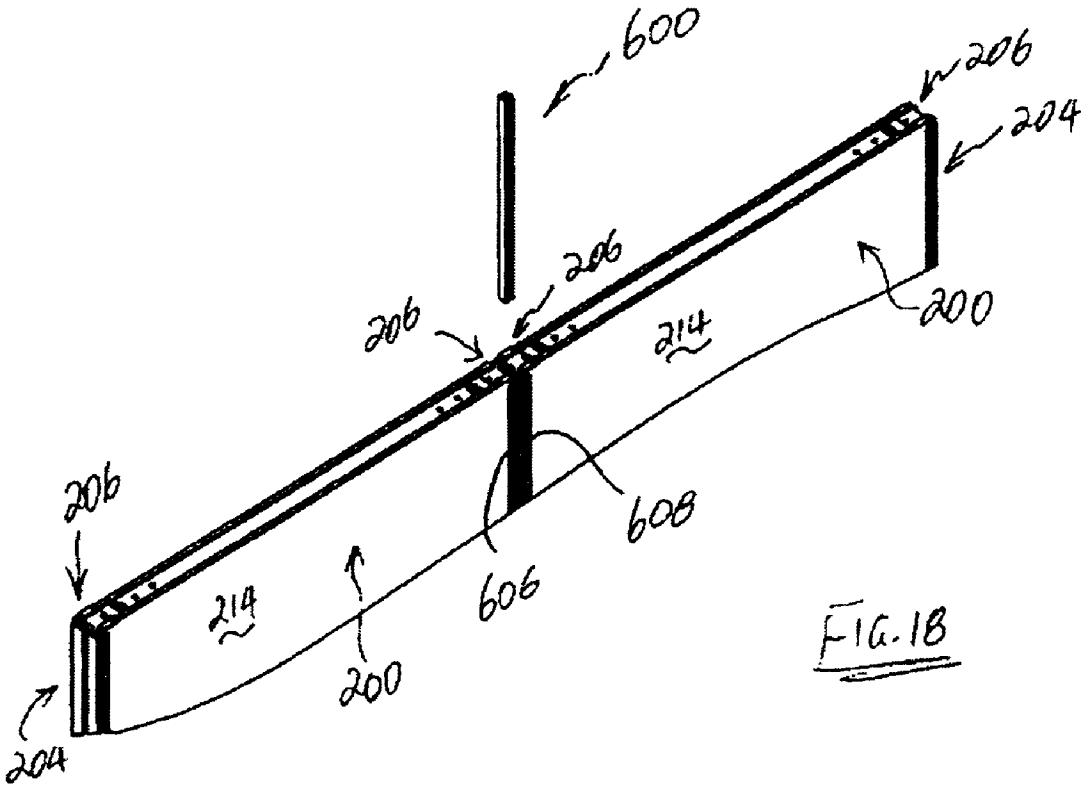
FIG. 18 is an isometric view of connecting two wall panel assemblies using the I-beam connector of FIG. 17.

FIG. 18 is an illustration of a method for connecting two framed panels 200 side-by-side. In an embodiment of the method, side frame member 204 on framed panel 200 is positioned adjacent side frame member 204 on second framed panel 200, such that the two framed panels 200 are longitudinally aligned. Next, each arm 602 of I-beam connector 600 is positioned within adjacent channels 238 of each side frame member 204. With channels 238 configured for slidably engaging arms 602, I-beam connector 600 is slidably positioned at a location along the side of wall panel assemblies 208.

Figure 19:
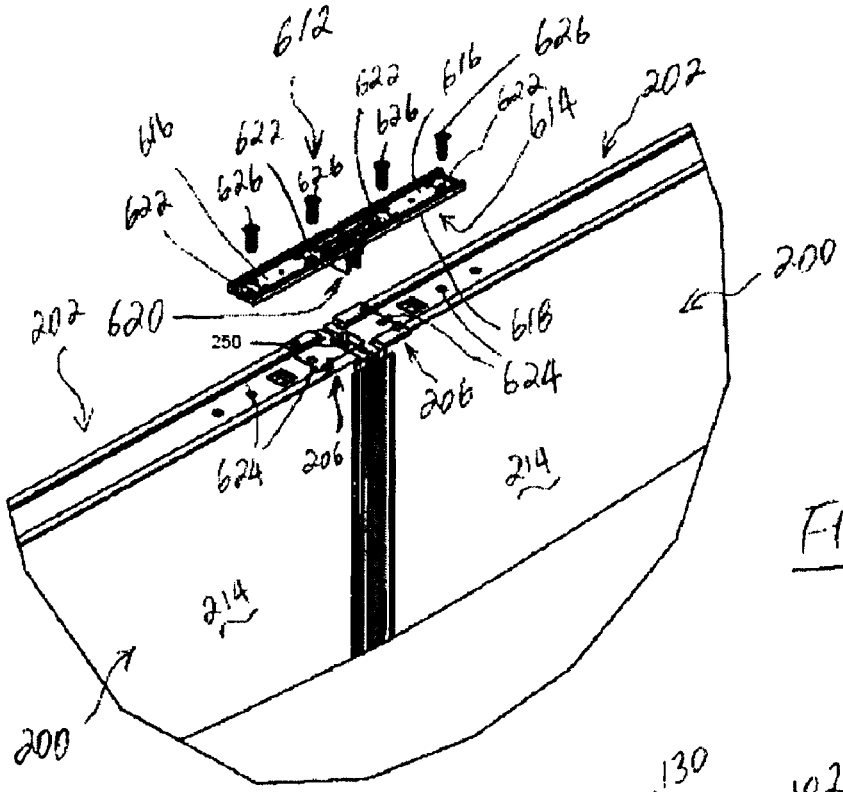
FIG. 19 is an isometric view of an embodiment of a frame connector for connecting together the top frame members of two wall panel assemblies.

In FIG. 19 is shown frame connector 612 for completing and stabilizing the connection of two framed panels 200 illustrated in FIG. 18. An embodiment of frame connector 612 includes longitudinally extending member 614 having a top and a bottom surface 616 and 618, respectively. Extending orthogonally outward from approximately the mid-point of bottom surface 618 are spaced apart engagement tabs 620. Each engagement tab 620 is configured for engagement within channel 250 of first frame corner connector 206. Frame connector 612 includes fastener openings 622 aligned with fastener receptors 624 on top frame member 202 and first frame corner connector 206. In an embodiment of the invention, fastener 626 attaches frame connector 612 to top frame member 202, and fastener 626 attaches frame connector 612 to top frame member 202 with intermediate portion 242 of first frame corner connector 206 sandwiched between frame connector 612 and top frame member 202.

Figure 20:
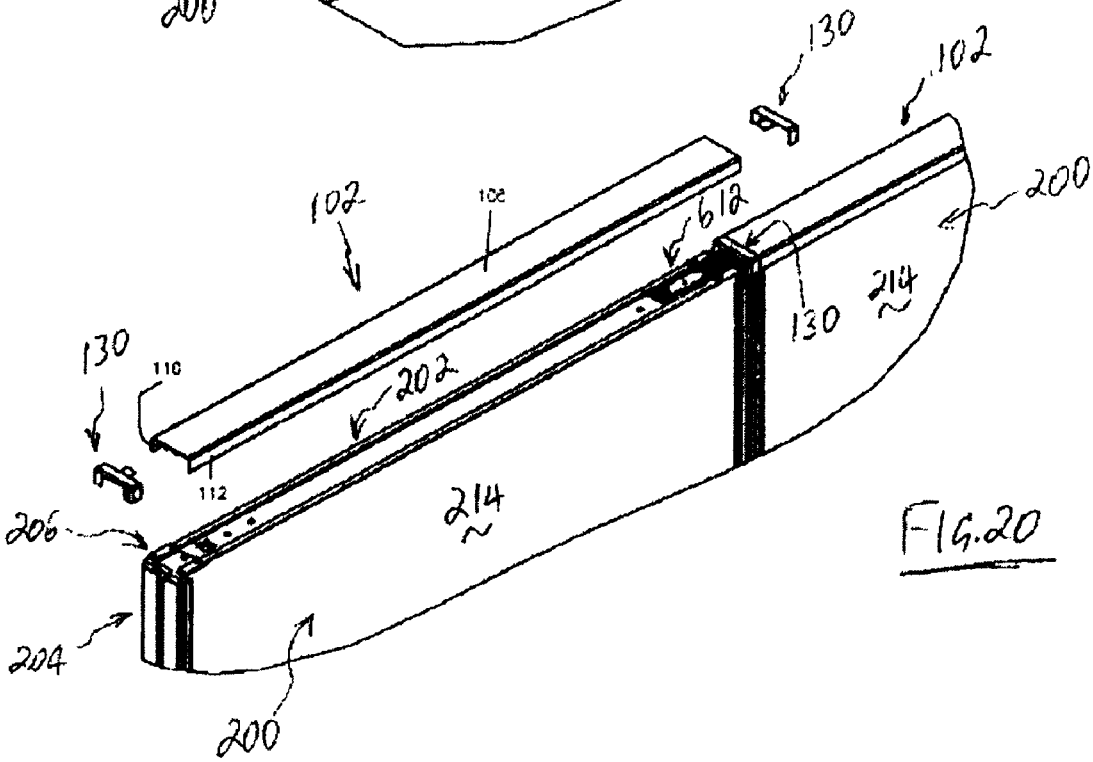
FIG. 20 is an isometric view of the top surface of two wall panel assemblies connected using the connector of FIG. 19.

FIG. 20 illustrates the installation of decorative top cap frame 102 along the top surfaces of framed panels 200. Having framed panels 200 connected with frame connector 612 and fasteners 626, side arms 110 and 112 of decorative top cap frame 102 snap in place and engage the sides of top frame member 202. Decorative transition cap 130 is used for bridging or covering any gaps or openings between two adjacent decorative top cap frames 102. In an alternate embodiment, decorative end cap 104 is used as an end piece instead of decorative transition cap 130 at an end of decorative top cap frame 102.

Figure 21:
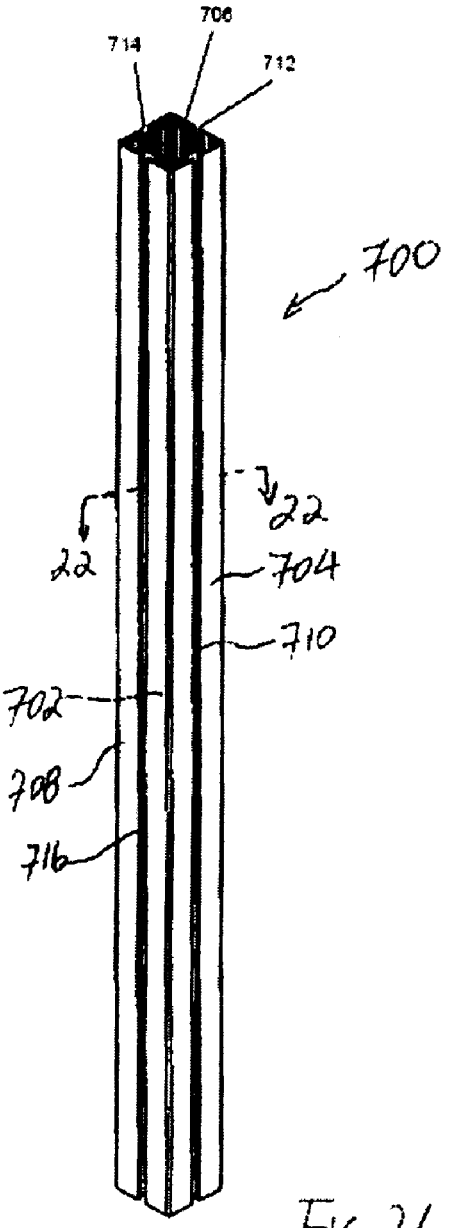
FIG. 21 is an isometric view of a connector post.
Figure 22:
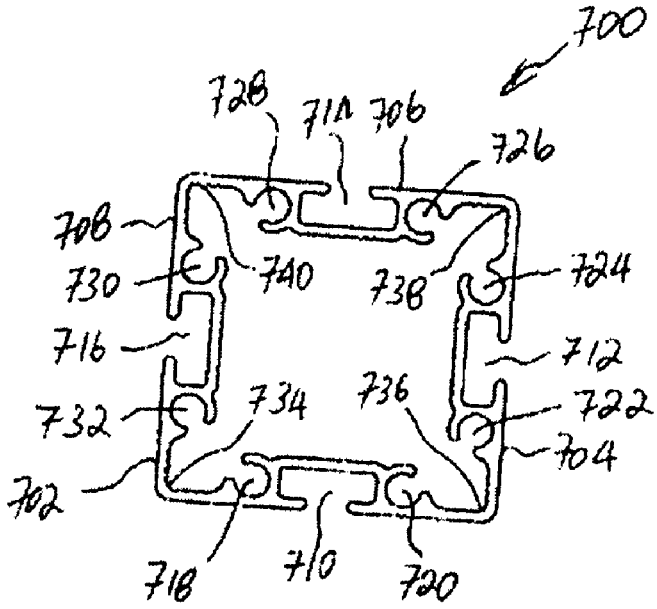
FIG. 22 is a cross-sectional view of the connector post of FIG. 21 along line 22-22.

FIGS. 21 and 22, respectively, are an isometric view and a cross-sectional view of connector post 700 for connecting two framed panels 200 at an angle. An embodiment of connector post 700 has a generally square cross sectional configuration having outer walls 702, 704, 706 and 708, and open channels 710, 712, 714 and 716. Each open channel 710, 712, 714 and 716 is configured for slidably engaging arm 602 of I-beam connector 600. Additionally, each open channel 710, 712, 714 and 716, respectively, is flanked by a pair of open circular channels 718 and 720, 722 and 724, 726 and 728, and 730 and 732 on the inside surfaces of connector post 700. Each of these circular channels are configured for receiving fasteners such as screws or the like. Outer walls 702, 704, 706 and 708 define interior corners 734, 736, 738 and 740, respectively.

Figure 23:
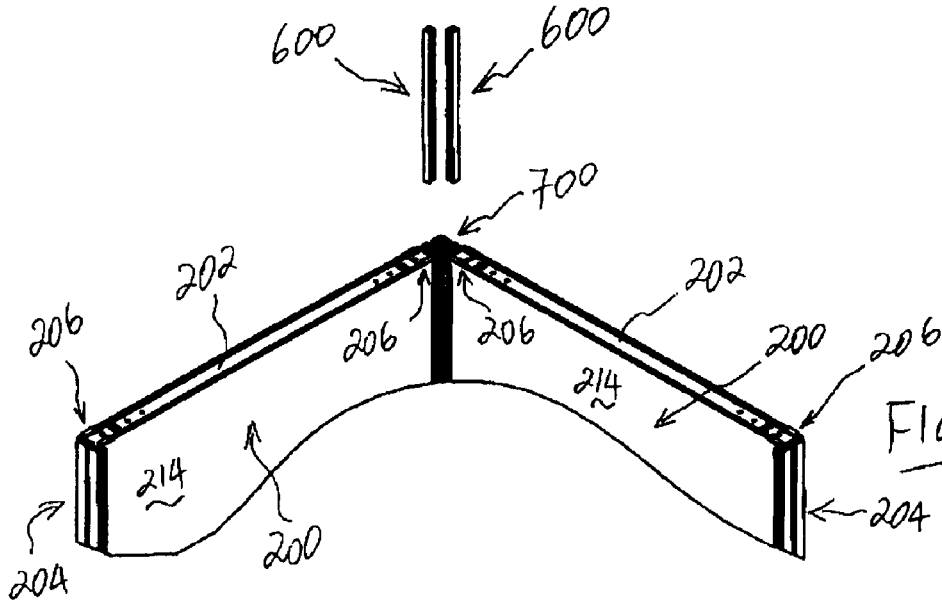
FIG. 23 is an isometric view of attaching two wall panel assemblies at an angle.

FIG. 23 shows an embodiment of connecting together two framed panels 200 to form a corner for the work space. Connector post 700 is positioned in the outer corner between framed panels 200 such that the outside surfaces of two orthogonal walls of connector post 700 abut the outside surfaces of the side frame members 204. I-beam connector 600 is used for connecting framed panels 200 to connector post 700 by placing arm 602 of I-beam connector 600 into channel 238 of side frame member 204 and placing the other arm 602 of I-beam connector 600 into a channel (such as channels 710, 712, 714 and 716) of connector post 700.

It will be obvious to those skilled in the art that, by the nature of its design, connector post 700 provides flexibility and versatility in arranging framed panels 200. In an embodiment of the invention, connector post 700 enables linear connection of two framed panels 200. In another embodiment, connector post 700 is used for forming a corner in the workspace by connecting two framed panels 200 orthogonal to each other. In yet another embodiment, framed panels 200 can be connected orthogonally to each of its adjacent framed panels 200, resulting in a X-shaped configuration. In an alternate embodiment, connector post 700 connects framed panels 200 in a T-shaped configuration.

Figure 24:
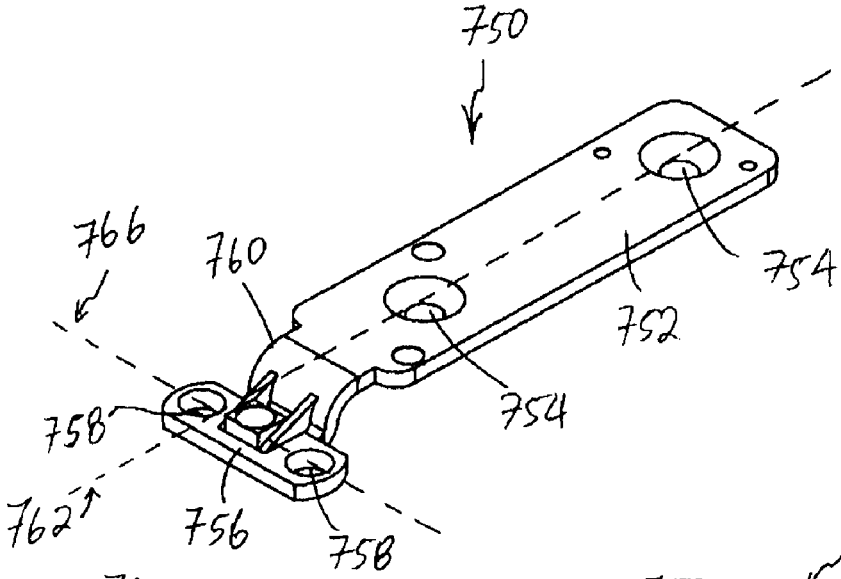
FIG. 24 is an isometric view of a first bracket for securing a wall panel assembly to a connector post.
Figure 25:
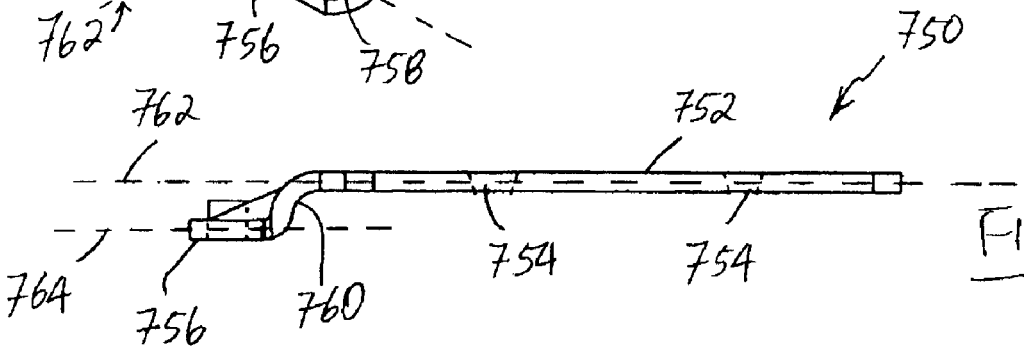
FIG. 25 is a side view of the first bracket of FIG. 24.

FIGS. 24 and 25, respectively, show a perspective view and a side view of first bracket 750 for securing connector post 700 to framed panel 200. An embodiment of first bracket 750 includes long end 752 having fastener openings 754; and short end 756 also having fastener openings 758. Shoulder 760 attaches long end 752 and short end 756 to each other at an offset as illustrated by the spacing between lines 762 and 764, each of which lines respectively represents the plane of long and short ends 752 and 756. In an embodiment of first bracket 750, line 766 connecting fastener openings 758 on short end 756 is substantially orthogonal to line 762 connecting faster openings 754 on long end 752. Fastener openings 754 in an embodiment of first bracket 750 are configured for alignment with fastener receptors 624 on top frame member 202 and first frame corner connector 206, and fastener openings 758 are configured for alignment with each pair of open circular channels 718 and 720, 722 and 724, 726 and 728, and 730 and 732 on the inside surfaces of connector post 700.

Figure 26:
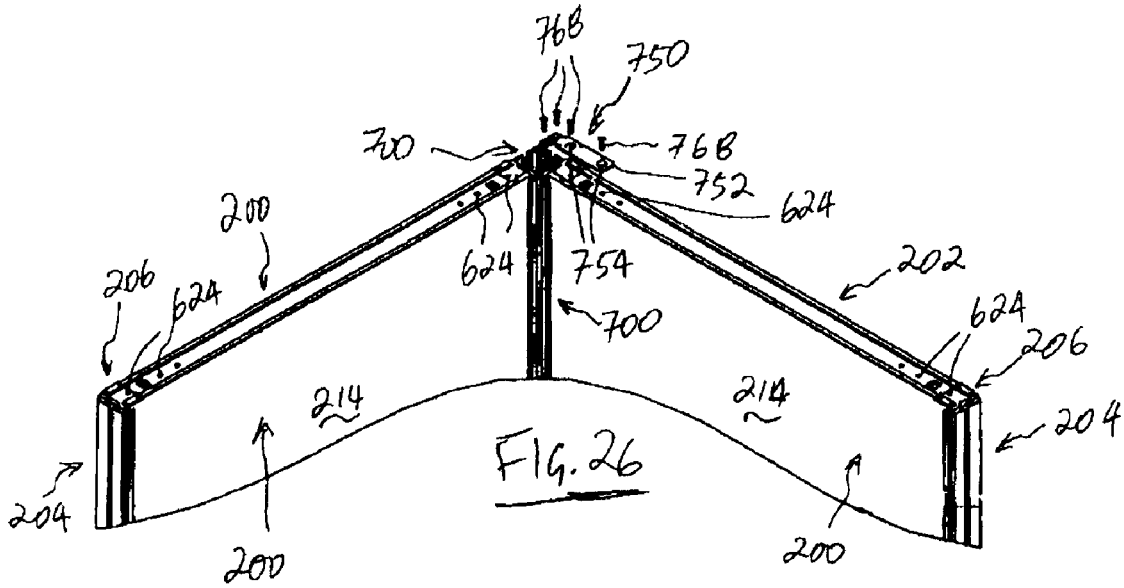
FIG. 26 is a perspective view illustrating the use of the first bracket of FIG. 24.

FIG. 26 illustrates the installation of first bracket 750 and securing framed panel 200 to connector post 700 in accordance with an embodiment of the invention. Short end 756 of first bracket 750 is positioned at the end of connector post 700 with fastener holes 758 aligned over pair of open circular channels 718 and 720, 722 and 724, 726 and 728, and 730 and 732 on the inside surfaces of connector post 700. And, long end 752 of connector post 700 is positioned on top frame member 202 with fastener holes 754 aligned over fastener receptors 624. Fasteners 768 through fastener openings 758 engage open circular channels in connector post 700 thereby securing short end 756 to connector post 700. Also, fastener 768 attaches long end 752 to fastener receptor 624 in top frame member 202, and fastener 768 attaches long end 752 to fastener receptor 624 in top frame member 202 with intermediate portion 242 of first frame corner connector 206 sandwiched therebetween. Framed panel 200 is fixedly secured to connector post 700.

Figure 27:
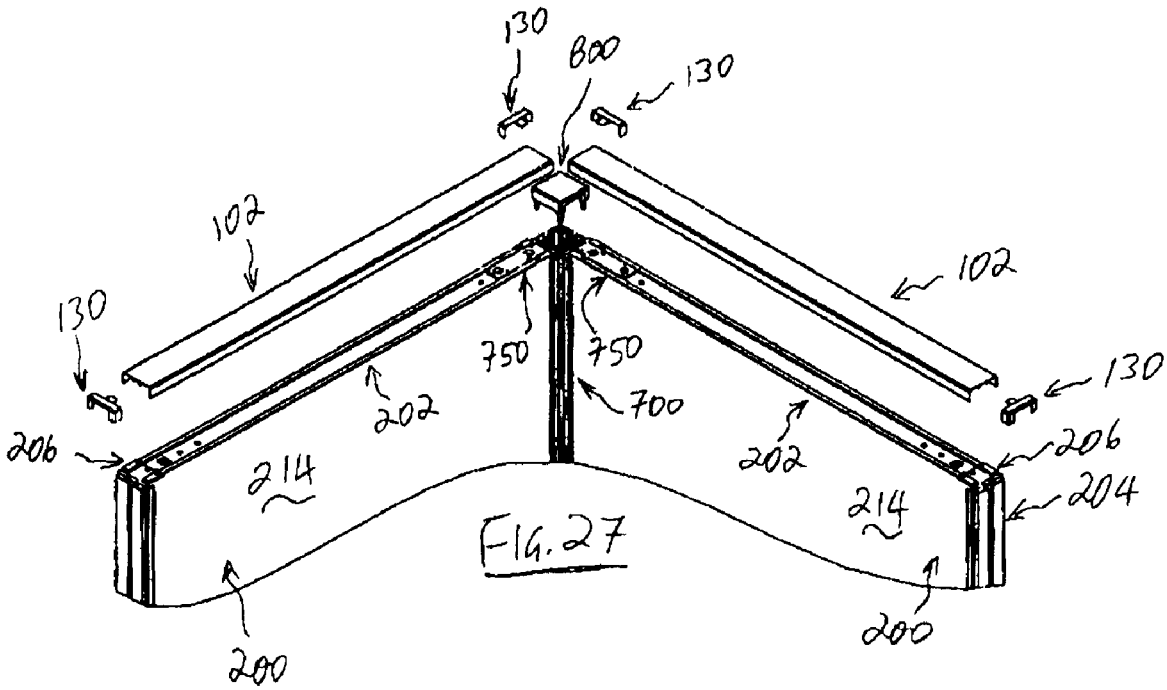
FIG. 27 is a perspective view illustrating the installation of decorative caps for the assembly of FIG. 26.

FIG. 27 illustrates the installation of decorative top cap frame 102 along the top surfaces of framed panel 200. With framed panel 200 connected to connector post 700, side arms 110 and 112 of decorative top cap frame 102 snap in place and engage the sides of top frame member 202. Decorative transition cap 130 is used for bridging or covering any gaps or openings between two adjacent decorative pieces. In an alternate embodiment, decorative end cap 104 is used as an end cap instead of decorative transition cap 130 at an end of decorative top cap frame 102. The exposed end opening of connector post 700 is covered, or capped, by decorative post cap 800 described in detail below.

Figure 28:
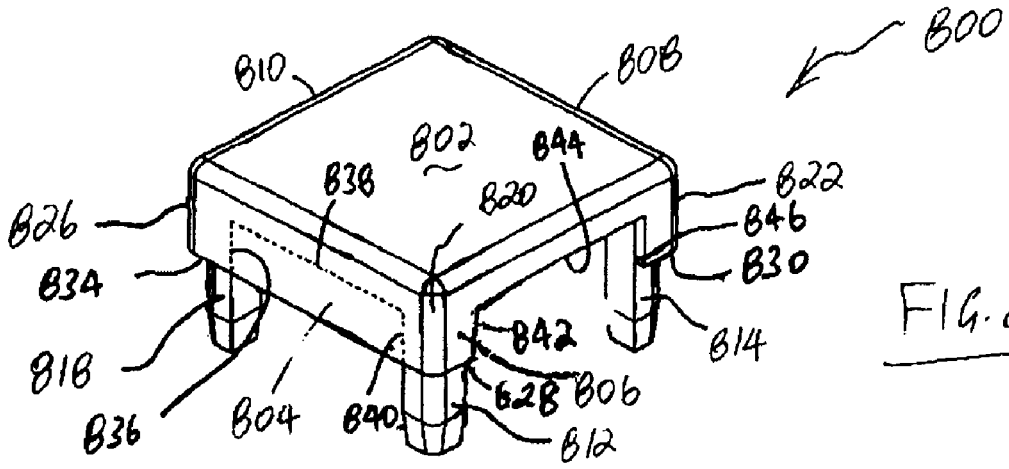
FIG. 28 is a perspective view of a decorative post cap.
Figure 29:
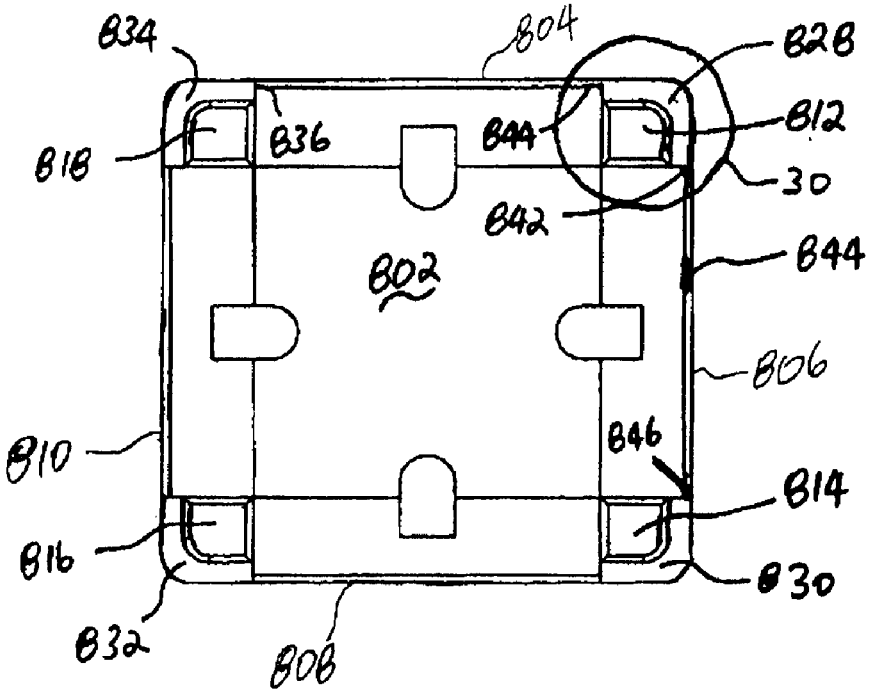
FIG. 29 is a bottom view of the decorative post cap of FIG. 28.
Figure 30:
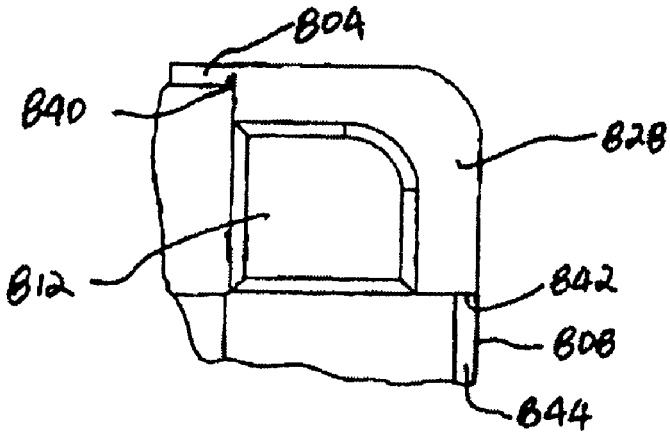
FIG. 30 is a plan view of a representative corner of FIGS. 28 and 29.

FIGS. 28 and 29, respectively, show a perspective view and a bottom view of decorative post cap 800; and FIG. 30 shows one of the corners as viewed from below. An embodiment of decorative post cap 800 includes top wall 802 having side walls 804, 806, 808 and 810, and support members 812, 814, 816 and 818 extending downwardly from top wall 802 and along corners 820, 822, 824 and 826 where side walls 804, 806, 808 and 810 intersect. Support members 812, 814, 816 and 818 include shoulders 828, 830, 832 and 834, respectively, for abutting an end edge of connector post 700.

The outside dimensions of an embodiment of decorative post cap 800 are substantially the same as the outside dimension of connector post 700. Support members 812, 814, 816 and 818 are configured for engagement with interior corners 734, 736, 738 and 740 of connector post 700. When decorative post cap 800 is applied to an end of connector post 700, an aesthetically pleasing appearance is achieved having a substantially level top surface extending along framed panel 200 and connector post 700. An embodiment of decorative post cap 800 includes scores or scribes 836, 838 and 840 on each side wall 804, 806, 808 and 810. Scores 836, 838 and 840 provide flexibility, adjustability and versatility for attaching decorative post cap 800 to an end of connector post 700. Scores 836, 838 and 840 provide for stress concentration and ease the removal of a section of one or more side walls 804, 806, 808 and 810 by an installer. For example, portions of two adjacent side walls have been removed in decorative post cap 800 shown in FIG. 27. In the decorative post cap 800 shown in FIG. 28, side wall 806 has been partially removed leaving edges 842, 844 and 846. Removal is accomplished by gripping a wall, for example with a pliers, and applying torque. In some installations, such as an X-shaped wall panel assembly, portions of each side wall 804, 806, 808 and 810 are removed from decorative post cap 800. In alternate installations having linearly aligned wall panel assemblies, portions of opposing side walls are removed. In other installations such as a T-shaped wall panel assembly, portions of three of the four side walls are removed. Decorative post cap 800 becomes a single item inventory which can be easily configured for the application at hand.

Figure 31:
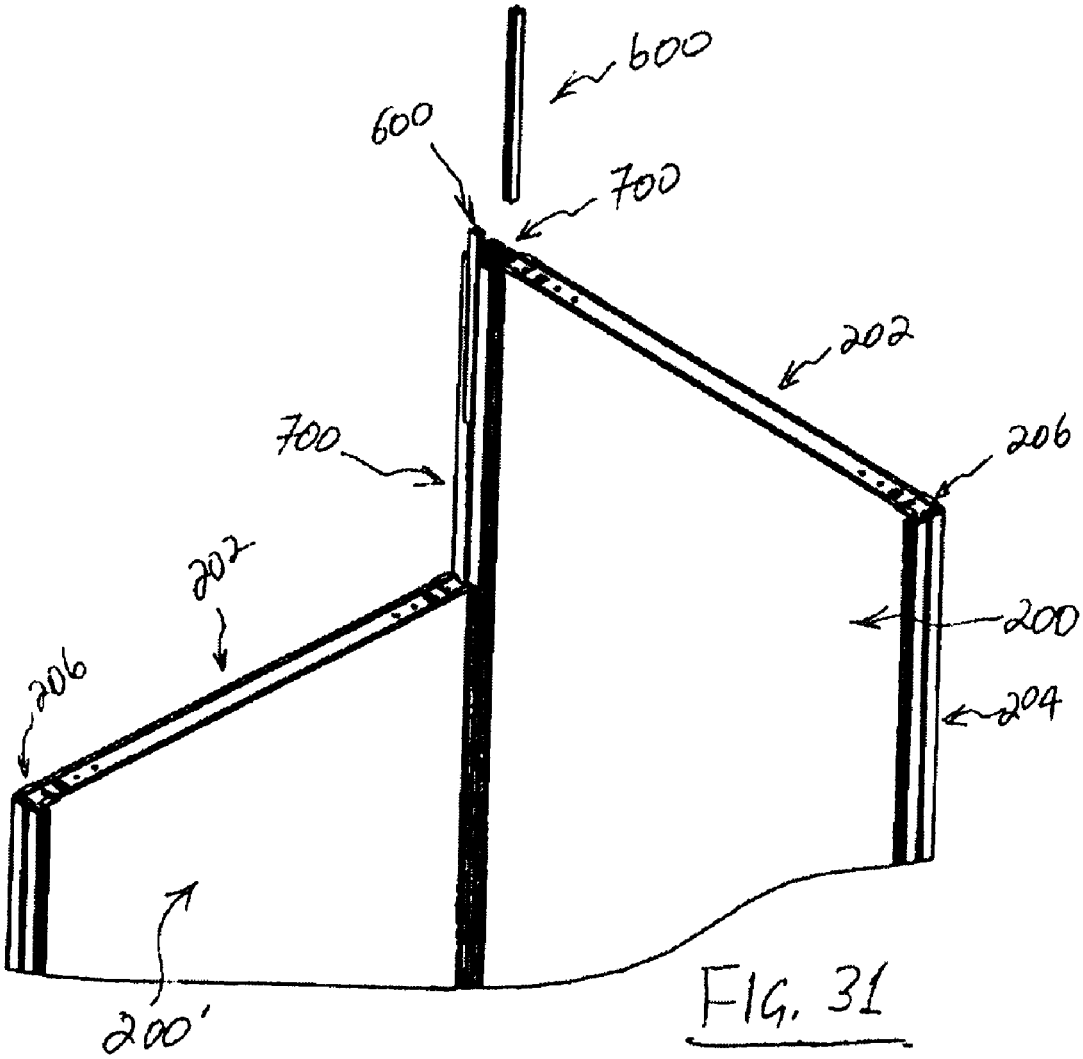
FIG. 31 is a perspective view of an installation having wall panel assemblies of different heights.
Figure 32:
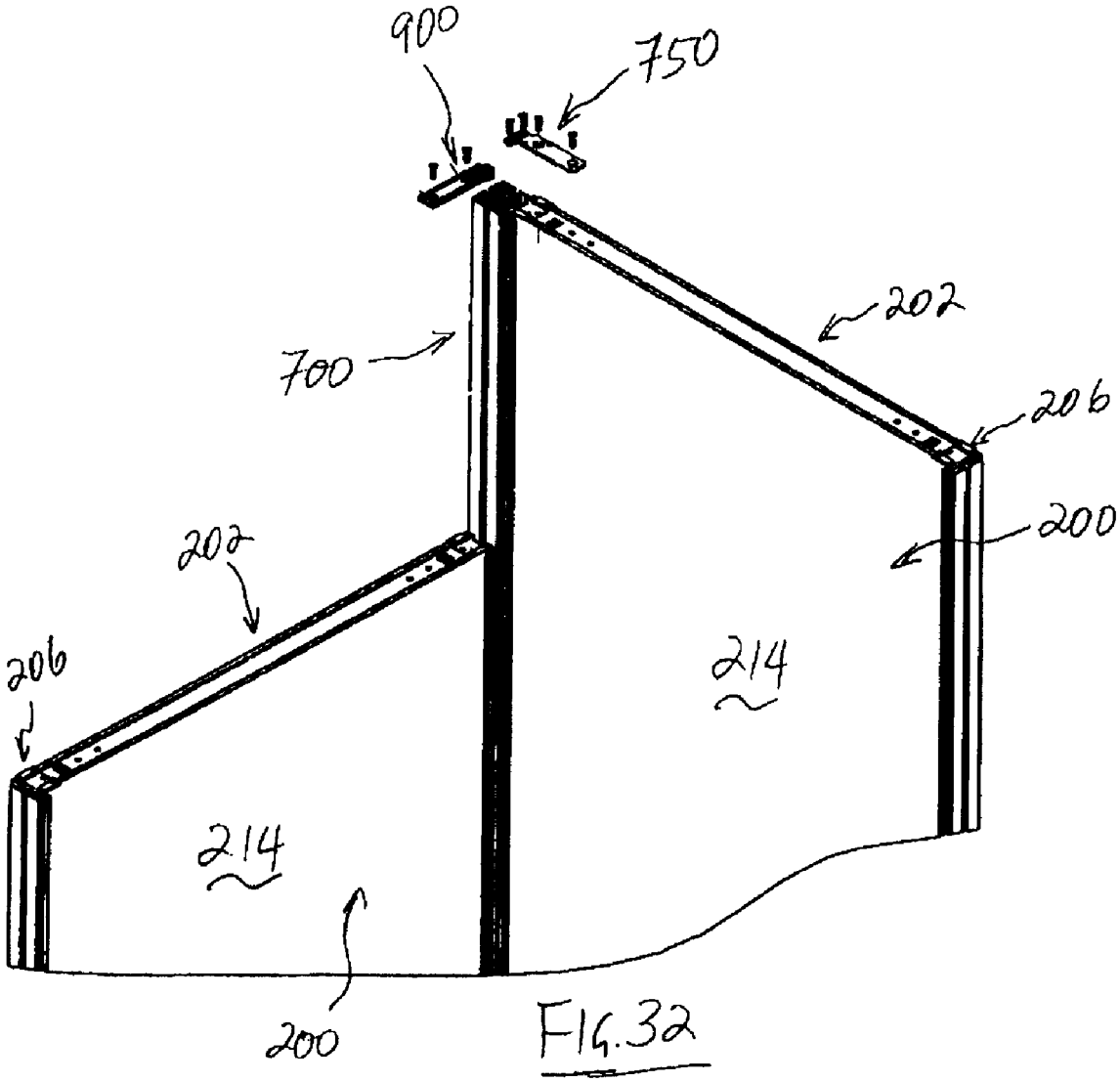
FIG. 32 is a perspective view of the continuing assembly of the wall panel assemblies of FIG. 31.

FIGS. 31 and 32 illustrate the assembly of relatively tall framed panel 200 and relatively short framed panel 200'. As with the previously described framed panel assemblies 200 illustrated in FIGS. 23, 26 and 27, framed panels 200 and 200' are engaged to connector post 700 using a plurality of I-beam connectors 600. Each arm 602 of I-beam connector 600 is engaged in a channel (such as channels 710, 712, 714 and 716) of connector post 700 and in channel 238 of side frame member 204. Next, first bracket 750 is used, as previously described in relation to FIG. 26, for securely attaching the top surface of framed panel 200 to an end of connector post 700 as illustrated in FIG. 32. Second bracket 900, described in greater detail below in reference to FIGS. 33-35, securely attaches the top surface of relatively short framed panel 200' to connector post 700.

Figure 33:
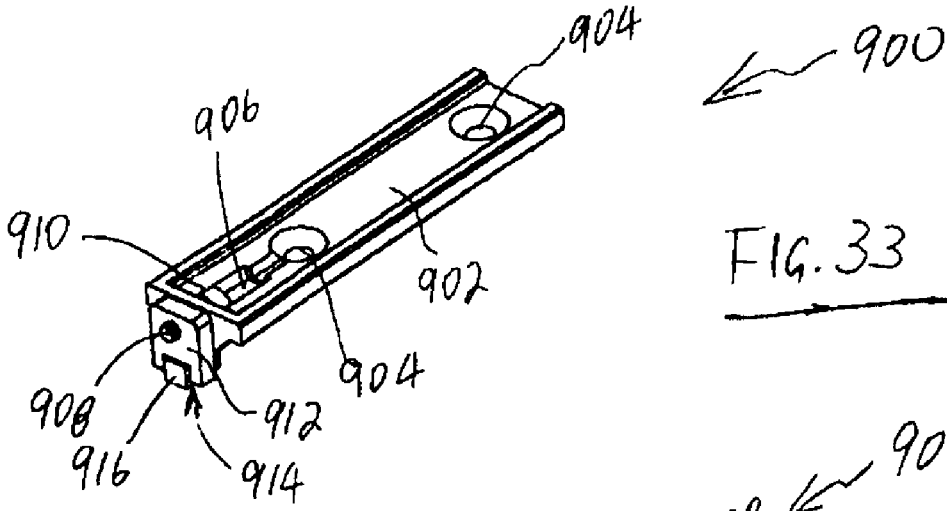
FIG. 33 is a perspective view a second bracket for assembling wall panel assemblies of different heights.
Figure 34:
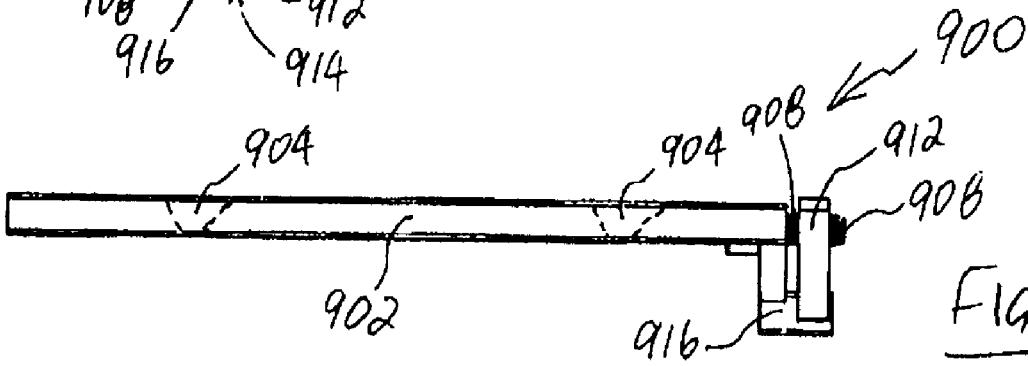
FIG. 34 is a side view of the second bracket of FIG. 33.
Figure 35:
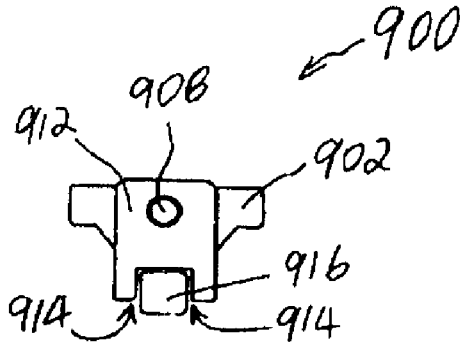
FIG. 35 is a front view of the second bracket of FIG. 33.

FIGS. 33 and 34, respectively, are a perspective view and a side view of second bracket 900; and FIG. 35 is an end view of the proximal end of second bracket 900. An embodiment of second bracket 900 includes longitudinally extending member 902 having fastener openings 904, wherein fastener openings 904 are aligned with fastener receptors 624 as previously described. Second bracket 900 also includes longitudinal recess 906 at a proximal end of longitudinally extending member 902. Operable fastener 908 is disposed lengthwise through head 912 and extends through fastener receptor 910 into longitudinal recess 906. Notch 914 in head 912 houses an end of retaining slider 916 extending at an offset from the proximal end of longitudinally extending member 902. Retaining slider 916 is configured for slidable engagement in a channel (such as channels 710, 712, 714 and 716) of connector post 700. In use, head 912 and retaining slider 916 are slideably disposed within a channel of connector post 700 with longitudinally extending member 902 resting along the top surface of framed panel 200'. With fastener openings 904 aligned with fastener receptors 624 in top frame member 202, fasteners (not shown) securely attach framed panel 200' to connector post 700. Operable fastener 908 is then operated to move head 912 towards or away from the proximal end of longitudinally extending member 902. With head 912 slideably engaged within a channel of connector post 700 and longitudinally extending member 902 fastened to framed panel 200', operable fastener 908 is operated to tighten or loosen the engagement of head 912 against at least one inside wall of a channel of connector post 700.

Figure 36:
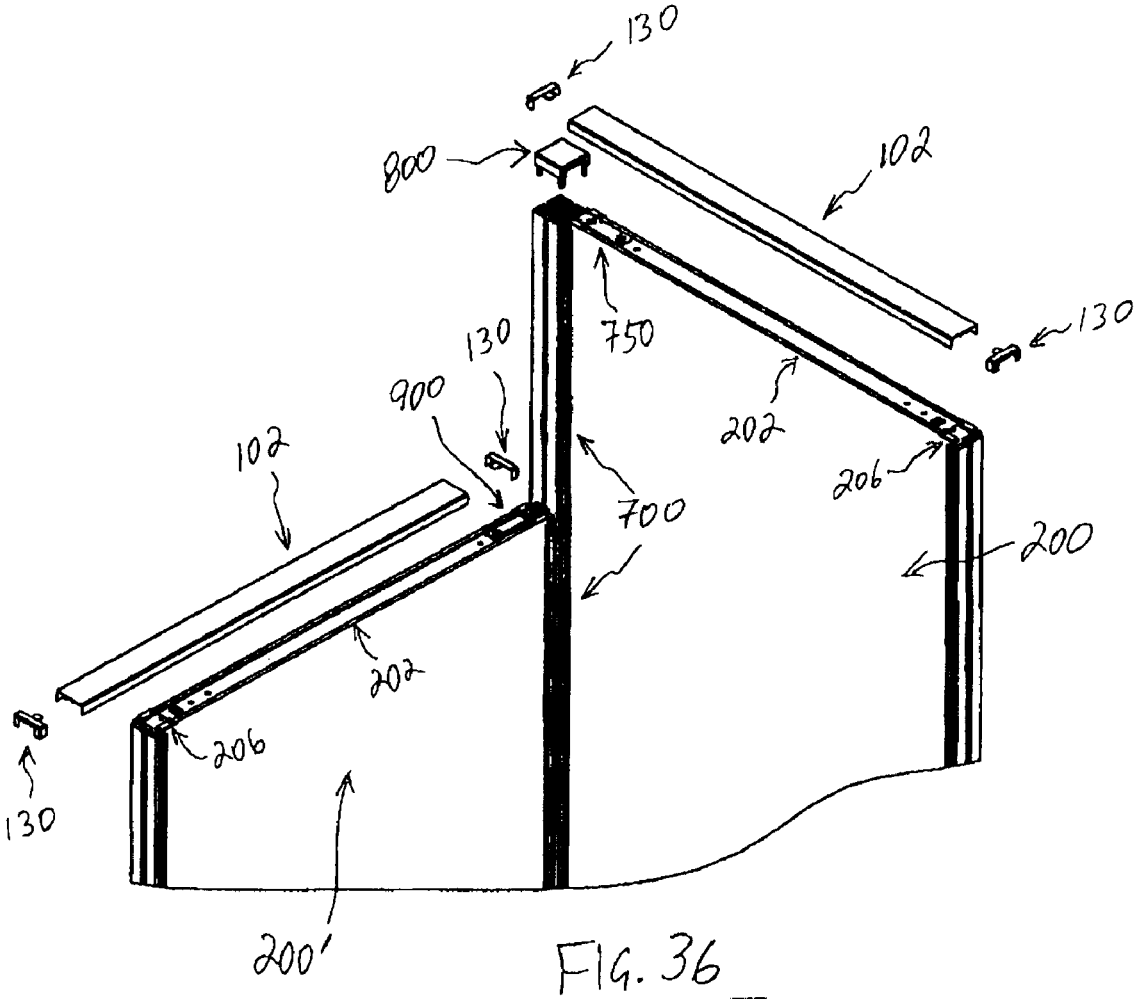
FIG. 36 is a perspective view illustrating completion of assembling wall panel assemblies of different heights.

Next, as illustrated in FIG. 36, decorative top caps 102 and decorative transition caps 130 are affixed to top frame members 202; decorative post cap 800 is engaged at the open end of connector post 700. This then completes a wall system comprising framed panels 200 and 200' in accordance with an embodiment of the invention.

Described herein above is an embodiment of the invention comprising wall panel assemblies having one or more embodiments for each of the framed panel, connectors, decorative caps, and other components required for the assembly. Alternative embodiments of the individual components and/or the assembly will be apparent to one skilled in the art. All variations are within the scope, intent, and extent of the invention.

What is claimed is:

1. A wall panel assembly comprising:

one or more panels secured within a frame, the frame comprising a plurality of frame members, the frame members including at least one top frame member, at least one bottom frame member, and at least two side frame members, the top frame member comprising at least one generally C-shaped first channel engaging at least a portion of a first frame corner connector;

the bottom frame member engaging at least a portion of a support member;

each side frame member comprising:

at least one primary channel, the primary channel engaging at least a portion of the first frame corner connector;

at least one generally C-shaped second channel on an outside surface of the primary channel, the C-shaped second channel engaging at least a portion of the first frame corner connector;

first and second retaining channels extending outwardly from opposite sides of the C-shaped second channel, the first and second retaining channels engaging at least a portion of the first frame corner connector; and first and second side channels extending outwardly from opposite sides of the primary channel, the first and second side channels securing at least one edge of one or more panels.

2. The wall panel assembly of claim 1, wherein the first frame corner connector comprises:

an intermediate portion;

a first arm extending longitudinally from the intermediate portion, the first arm engaging within the C-shaped first channel of the top frame member;

a second arm extending transversally from the intermediate portion, the second arm engaging within the primary channel of the side frame member; and a first and a second spaced apart prongs extending transversally and longitudinally from the intermediate portion, the first and the second prong respectively engaging within the first and the second retaining channels of the side frame member.

3. The wall panel assembly of claim 2, wherein the support member comprises a column having feet at one end of the column and a second frame corner connector at the other end of the column.

4. The wall panel assembly of claim 3, wherein the second frame corner connector comprises:

a first arm extending transversally from the end of the column, the first arm engaging within the bottom frame member;

a second arm extending longitudinally from the end of the column, the second arm engaging within the primary channel of the side frame member; and a first and a second spaced apart prongs extending transversally and longitudinally from the end of the column, the first and the second prong respectively engaging within the first and the second retaining channels of the side frame member.

5. The wall panel assembly of claim 4, wherein the first arm is configured as a fork having at least two times.

6. The wall panel assembly of claim 4, wherein the panel comprises a natural fiber.

7. The wall panel assembly of claim 3 including a frame connector, the frame connector securing at least a portion of the frame connector to each of at least two adjacent frames.

8. The wall panel assembly of claim 7, wherein the at least two adjacent frames align along and share a common plane.

9. The wall panel assembly of claim 7, wherein the at least two adjacent panels are at an angle to each other.

10. The wall panel assembly of claim 7, wherein the frame connector comprises:

a longitudinally extending member having a top surface and a bottom surface;

at least two spaced apart engagement tabs extending transversally from the bottom surface at a location proximate a mid-point of the member, wherein each engagement tab is configured for engagement between the spaced apart prongs of the first frame corner connector; and a plurality of fastener openings configured for securing at least a portion of the frame connector to each of the at least two adjacent frames.

11. The wall panel assembly of claim 10, wherein the plurality of fastener openings in the frame connector are aligned with a plurality of fastener receptors on the top frame member or the first frame corner connector or both.

12. The wall panel assembly of claim 7, including a first bracket, the first bracket configured for securing the frame to a connector post.

13. The wall panel assembly of claim 12, wherein the first bracket comprises:

a longitudinally extending member having a plurality of fastener openings for securing at least a portion of the longitudinally extending member to at least a portion of the frame or the first frame corner connector or both;

a transversally extending member having a plurality of fastener openings for securing at least a portion of the transversally extending member to at least a portion of the connector post; and a shoulder connecting the longitudinally extending member to the transversally extending member at an offset.

14. The wall panel assembly of claim 13, wherein the plurality of fastener openings in the longitudinally extending member are aligned with a plurality of fastener receptors on the top frame member or the first frame corner connector or both; and the plurality of fastener openings in the transversally extending member are aligned with a plurality of fastener receptors in the connector post.

15. The wall panel assembly of claim 12, further comprising a second bracket, the second bracket comprising:

a retaining slider at an end of a longitudinally extending member; and a head housing at least a portion of the retaining slider, the head spaced apart from and movably secured to the end of the longitudinally extending member.

16. The wall panel assembly of claim 15, wherein the head is configured for slideable engagement within a longitudinally extending channel on the connector post.

17. The wall panel assembly of claim 16, wherein an operable fastener movably secures the head to a fastener receptor at the end of the longitudinally extending member.

18. The wall panel assembly of claim 17, wherein the operable fastener is configured for tightening or loosening the head against one or more internal walls of the longitudinally extending channel on the connector post in which the head is slideably engaged.

19. The wall panel assembly of claim 12, wherein a surface of the intermediate portion opposite the second arm is fixedly secured to the end of the column opposite the end having the feet.

20. The wall panel assembly of claim 15, wherein the retaining slider is configured for slideable engagement through a longitudinally extending opening on a side of the longitudinally extending channel on the connector post.

21. The wall panel assembly of claim 20, wherein the retaining slider is transversally spaced apart from a surface of the longitudinally extending member.

22. The wall panel assembly of claim 20, wherein the longitudinally extending member includes a plurality of fastener openings for securing the second bracket to the frame.

23. The wall panel assembly of claim 22, wherein the plurality of fastener openings are aligned with a plurality of fastener receptors on the top frame member or on the first frame corner connector or both.

24. A frame for a wall panel assembly, the frame comprising:

a first and a second frame corner connector;

a plurality of frame members, wherein a first and a second frame member are each configured for engaging at least a portion of the first frame corner connector;

a third and a fourth frame member are each configured for engaging at least a portion of the second frame corner connector;

the first frame corner connector secures together the first and the second frame members;

the second frame corner connector secures together the third and the fourth frame members;

a first bracket configured for securing the frame to a connector post, the first bracket comprising:

a longitudinally extending member having a plurality of fastener openings for securing at least a portion of the longitudinally extending member to at least a portion of the frame or the first frame corner connector or both;

a transversally extending member having a plurality of fastener openings for securing at least a portion of the transversally extending member to at least a portion of the connector post;

a shoulder connecting the longitudinally extending member to the transversally extending member at an offset;

a second bracket configured for securing the frame to a connector post, the second bracket comprising:

a retaining slider at an end of a longitudinally extending member, the retaining slider configured for slideable engagement through a longitudinally extending opening on a side of a longitudinally extending channel on the connector post;

a head housing at least a portion of the retaining slider, the head spaced apart from the end of the longitudinally extending member and configured for slideable engagement within the longitudinally extending channel on the connector post;

an operable fastener movably securing the head to a fastener receptor at the end of the longitudinally extending member, wherein the operable fastener is configured for tightening or loosening the head against one or more internal walls of the longitudinally extending channel on the connector post in which the head is slideably engaged;

a plurality of fastener openings configured for securing at least a portion of the second bracket to the frame.

25. A frame for a wall panel assembly, the frame comprising:

a first and a second frame corner connector;

a plurality of frame members, comprising:

a first frame member configured for engaging at least a portion of the first frame corner connector;

a second frame member configured for engaging at least a portion of the first and the second frame corner connectors;

a third frame configured for engaging at least a portion of the second frame corner connector;

the first frame corner connector secures together the first and the second frame members;

the second frame corner connector secures together the second and the third frame members;

a first bracket configured for securing the frame to a connector post, the first bracket comprising:

a longitudinally extending member having a plurality of fastener openings for securing at least a portion of the longitudinally extending member to at least a portion of the frame or the first frame corner connector or both;

a transversally extending member having a plurality of fastener openings for securing at least a portion of the transversally extending member to at least a portion of the connector post;

a shoulder connecting the longitudinally extending member to the transversally extending member at an offset;

a second bracket configured for securing the frame to a connector post, the second bracket comprising:

a retaining slider at an end of a longitudinally extending member, the retaining slider configured for slideable engagement through a longitudinally extending opening on a side of a longitudinally extending channel on the connector post;

a head housing at least a portion of the retaining slider, the head spaced apart from the end of the longitudinally extending member and configured for slideable engagement within the longitudinally extending channel on the connector post;

an operable fastener movably securing the head to a fastener receptor at the end of the longitudinally extending member, wherein the operable fastener is configured for tightening or loosening the head against one or more internal walls of the longitudinally extending channel on the connector post in which the head is slideably engaged;

a plurality of fastener openings configured for securing at least a portion of the second bracket to the frame.

26. A wall panel assembly comprising:

one or more panels secured within a frame, the frame comprising a plurality of frame members, the frame members including at least one top frame member, at least one bottom frame member, and at least two side frame members, the top frame member comprising at least one generally C-shaped first channel engaging at least a portion of a first frame corner connector, the first frame corner connector comprising:

an intermediate portion;

a first arm extending longitudinally from the intermediate portion, the first arm engaging within the C-shaped first channel of the top frame member;

a second arm extending transversally from the intermediate portion, the second arm engaging within the primary channel of the side frame member; and a first and a second spaced apart prongs extending transversally and longitudinally from the intermediate portion, the first and the second prong respectively engaging within the first and the second retaining channels of the side frame member, the bottom frame member engaging at least a portion of a support member, the support member comprising a column having feet at one end of the column and a second frame corner connector at the other end of the column;

each side frame member comprising:

at least one primary channel, the primary channel engaging at least a portion of the first frame corner connector;

at least one generally C-shaped second channel on an outside surface of the primary channel, the C-shaped second channel engaging at least a portion of the first frame corner connector;

first and second retaining channels extending outwardly from opposite sides of the C-shaped second channel, the first and second retaining channels engaging at least a portion of the first frame corner connector; and first and second side channels extending outwardly from opposite sides of the primary channel, the first and second side channels securing at least one edge of one or more panels;

a frame connector, the frame connector securing at least a portion of the frame connector to each of at least two adjacent frames;

a first bracket, the first bracket configured for securing the frame to a connector post; and a second bracket, the second bracket comprising a retaining slider at an end of a longitudinally extending member and a head housing at least a portion of the retaining slider, the head spaced apart from and movably secured to the end of the longitudinally extending member.

* * * * *

UNITED STATES PATENT AND TRADEMARK OFFICE

CERTIFICATE OF CORRECTION

PATENT NO. : 7,958,683 B2
APPLICATION NO. : 11/867327
DATED : June 14, 2011
INVENTOR(S) : Sam E. Abusada et al.

It is certified that error appears in the above-identified patent and that said Letters Patent is hereby corrected as shown below:

Column 11

Line 15

Please replace the word "times" with the word -- tines --

Signed and Sealed this
Nineteenth Day of June, 2012

David J. Kappos

David J. Kappos
*Director of the United States Patent and Trademark Office*